US006835692B2

(12) United States Patent
Ikeda et al.

(10) Patent No.: US 6,835,692 B2
(45) Date of Patent: Dec. 28, 2004

(54) HEAT-SENSITIVE RECORDING MATERIAL CONTAINING OXONOL DYE

(75) Inventors: Kimi Ikeda, Shizuoka-ken (JP); Shiki Ueki, Shizuoka-ken (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/678,640

(22) Filed: Oct. 6, 2003

(65) Prior Publication Data

US 2004/0121909 A1 Jun. 24, 2004

(30) Foreign Application Priority Data

Oct. 4, 2002 (JP) ..... 2002-291849

(51) Int. Cl.[7] ..... B41M 5/20
(52) U.S. Cl. ..... 503/216; 503/217; 396/575
(58) Field of Search ..... 503/217, 216; 396/575

(56) References Cited

U.S. PATENT DOCUMENTS 6,494,627 B2 * 12/2002 Mori et al. ..... 396/575

FOREIGN PATENT DOCUMENTS

JP 2000-43412 A 2/2000

OTHER PUBLICATIONS

"Diazo Type Thermal Recording Paper Fixable with UV Light" by Hirotsugu Sato et al., Bulletin of Image Electronics Association vol. 11, No. 4 (1982), pp. 290–296.

* cited by examiner

*Primary Examiner*—N. Edwards
(74) *Attorney, Agent, or Firm*—Sughrue Mion, PLLC

(57) ABSTRACT

The present invention provides a heat-sensitive recording material having a support and a heat-sensitive recording layer, which contains a diazonium salt compound and a coupler compound that reacts with the diazonium salt to develop a color, wherein the recording material contains an oxonol dye.

5 Claims, No Drawings

HEAT-SENSITIVE RECORDING MATERIAL CONTAINING OXONOL DYE

CROSS-REFERENCE TO RELATED APPLICATION

This application claims priority under 35 USC 119 from Japanese Patent Application No. 2002-291849, the disclosure of which is incorporated by reference herein.

BACKGROUND OF THE INVENTION

1. Field of the Invention

The present invention relates to a heat-sensitive recording material containing a diazonium salt and a coupler as color developing components, and more particularly to a heat-sensitive recording material, which suppresses green stains and has high background whiteness.

2. Description of the Related Art

A diazonium salt is generally a very chemically active compound, and reacts with a phenol derivative or a compound having an active methylene group, which is called a coupler, to easily form an azo dye. Also, the diazonium salt is photosensitive and, when irradiated with light, decomposes and loses activity.

Then, the diazonium salt is utilized as an optical recording material including a diazo-copying medium (for example, refer to "Base of Photographic Technology-Non-Silver Salt Photograph Chapter-" edited by Japan Photograph Society, Corona Publishing Co., Ltd. (1982), pp.89–117, pp.182–201). In recent years, the salt is also applied to recording materials for which fixation of an image is required. As a representative thereof, a light-fixing type heat-sensitive recording material having a recording layer which includes a diazonium salt and a coupler has been proposed. The heat-sensitive recording material is heated in accordance with image signals to react the diazonium salt and the coupler and to form an image, and then the image is fixed by light irradiation (for example, refer to Bulletin of Image Electronics Association, Hirotsugu Sato et al. vol. 11, No. 4 (1982), pp.290–296).

In a heat-sensitive recording material containing a diazonium salt compound and a coupler, various stains occur in certain cases. The hue of the stains is often yellow, but can also be green in certain cases.

Accordingly, there is a need for a heat-sensitive recording material in which green stains of the heat-sensitive recording material hardly occur.

SUMMARY OF THE INVENTION

In view of such a situation, the inventors of the invention have intensively studied, and, as a result, have found inclusion of an oxonol dye in a heat-sensitive recording material suppresses green stein and improves background whiteness, and have devised the invention.

The present invention provides a heat-sensitive recording material having a support and a heat-sensitive recording layer, which contains a diazonium salt compound and a coupler compound that reacts with the diazonium salt to develop a color, wherein the recording material contains an oxonol dye.

DETAILED DESCRIPTION OF THE INVENTION

The heat-sensitive recording material of the invention is characterized in that the material contains an oxonol dye in order to suppress green stains.

The heat-sensitive recording material of the invention will be explained in detail below.

The heat-sensitive recording material of the invention has at least one heat-sensitive recording layer on a support and, if necessary, may be provided with other layers such as a protective layer, and an intermediate layer.

In the invention, the oxonol dye may be contained in any layer, however is preferably contained in a layer containing a diazonium salt compound, that is a heat-sensitive recording layer.

<Oxonol Dye>

The oxonol dye used in the invention is not particularly limited, however an oxonol dye represented by the following formula (1) is preferable.

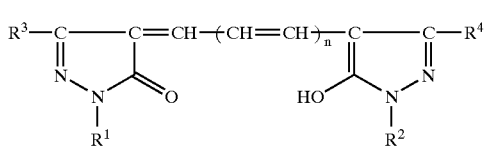

(1)

In formula (1), $R^1$, $R^2$, $R^3$ and $R^4$ represent independently an alkyl group, an aryl group, a substituted aryl group or a COOR group (wherein R represents a hydrogen atom, an alkyl group or an aryl group), and n represents 0, 1 or 2.

In formula (1), an alkyl group represented by $R^1$, $R^2$, $R^3$, $R^4$ or R is preferably an alkyl group having 1 to 10 carbon atoms, and is more preferably an alkyl group having 1 to 5 carbon atoms. Examples of the alkyl group include a methyl group, an ethyl group, a propyl group, an isopropyl group, an n-butyl group, a sec-butyl group, a t-butyl group, a pentyl group, a hexyl group, a heptyl group, a n-octyl group, a 2-ethylhexyl group, a t-octyl group, a nonyl group, a decyl group, a dodecyl group, a tridecyl group, a tetradecyl group, a pentadecyl group, a n-hexadecyl group, a 2-hexyldecyl group, a heptadecyl group, an octadecyl group, a nonadecyl group, an icosyl group, a henicosyl group, a docosyl group, a tricosyl group, a tetracosyl group, a 1,1-dimethylethyl group, and a 3,5,5-trimethylhexyl group.

In formula (1), examples of an aryl group represented by $R^1$, $R^2$, $R^3$, $R^4$ or R include a phenyl group and a naphtyl group. Examples of a substituent of a substituted aryl group include an alkyl group, a phenyl group, a halogen atom, an alkoxy group, an aryloxy group, an alkoxycarbonyl group, an acyloxy group, an acylamino group, a carbamoyl group, a cyano group, an alkylsulfonyl group, an arysulfonyl group, a sulfonamide group, a sufamoyl group, an acyl group, a heterocyclic group and a carboxyl group.

As the substituted aryl group, an aryl group having 6 to 20 carbon atoms is preferable, and examples thereof include a 2-methylphenyl group, a 3-methylphenyl group, a 4-methylphenyl group, a 2-phenylphenyl group, a 4-phenylphenyl group, a 2-chlorophenyl group, a 4-chlorophenyl group, a 4-bromophenyl group, a 2-methoxyphenyl group, a 2-butoxyphenyl group, a 2-(2-ethylhexyloxy)phenyl group, a 3-hexyloxyphenyl group, a 4-ethoxyphenyl group, a 4-hexyloxyphenyl group, a 4-(3,5,5-trimethylhexyloxy)phenyl group, a 2-phenoxyphenyl group, a 4-phenoxyphenyl group, a 2-methoxycarbonylphenyl group, a 4-ethoxycarbonylphenyl group, a 3-butoxycarbonylphenyl group, a 2-acetamidephenyl group, a 4-acetamidephenyl group, a 4-cyanophenyl group, a 2-octylsulfonylphenyl group, a 4-octylsulfonylphenyl group, a 2-dibutylaminocarbamoylphenyl group, a 4-dibutylaminocarbamoylphenyl group, a 4-cyclohexylphenyl group, a 2,5-dioctyloxyphenyl group, a 2,4-dihexyloxyphenyl group, and a 2,3-dimethoxyphenyl group.

A compound represented by formula (1) wherein $R^1$ and $R^2$ are a substituted-aryl group having a substituent with a dissociable proton or a salt thereof is particularly preferable. As the substituent with a dissociable proton, COOH and $SO_3H$ are preferable. In addition, as the salt of the substituent with the dissociable proton, COONa, COOK, $SO_2K$, and $SO_3Na$ are preferable.

In the heat-sensitive recording material of the invention, the amount of the oxonol dye is preferably $1\times10^{-6}$ to $1\times10^{-3}$ g/m$^2$, and particularly preferably $5\times10^{-5}$ to $5\times10^{-4}$ g/m$^2$.

Examples of the oxonol dye used in the invention include the following compounds.

(1-1)

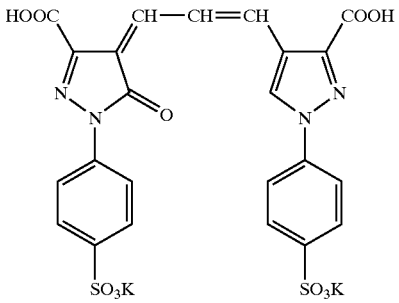

(1-2)

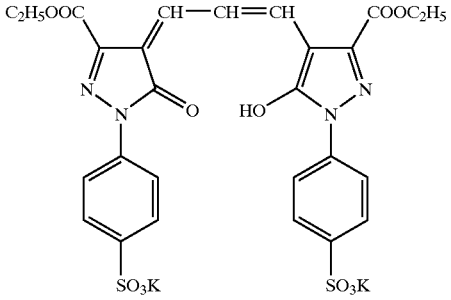

(1-3)

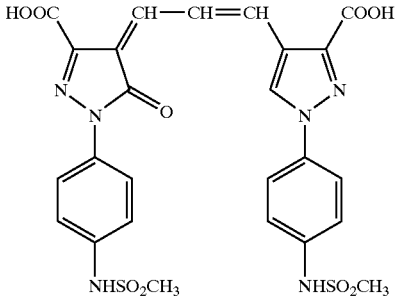

-continued

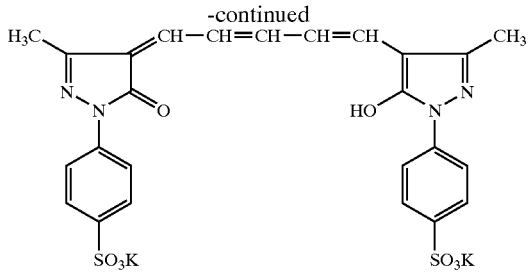

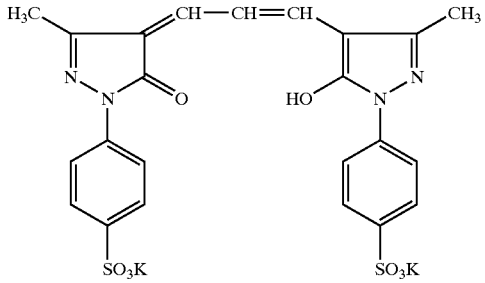

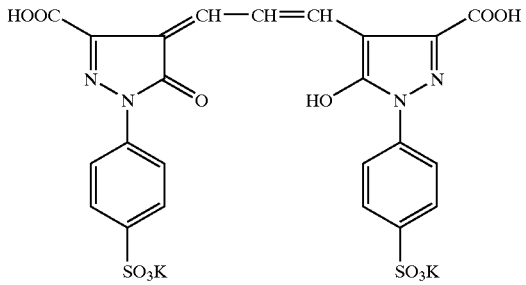

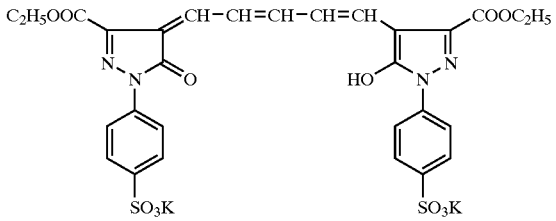

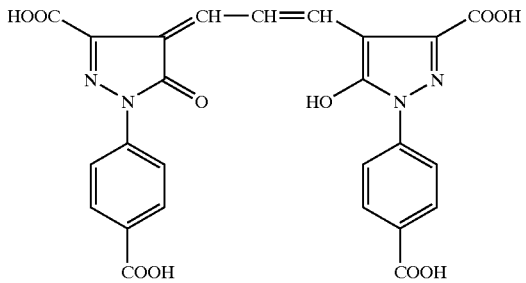

Furthermore, examples of the oxonol dye used in the invention and synthesizing methods thereof are described in WO88/04794, EP Nos. 0,274,723A1, 276,566, and 299,435, Japanese Patent Application Laid-Open (JP-A) Nos. 52-92716, 55-155350, 55-155351, 61-205934, 48-68623, 2-282244, and 3-167546, U.S. Pat. Nos. 2,527,583, 3,486,897, 3,746,539, 3,933,798, 4,130,429, and 4,040,841, and Japanese Patent Application No. 1-50874.

<Heat-sensitive Recording Layer>

The heat-sensitive recording layer in the invention contains a diazonium salt compound, and at least one coupler which reacts with the diazonium salt to develop a color and, if necessary, may contain other components.

Diazonium Salt

As the diazonium salt compound in the invention, known diazonium salt compounds can be used. However, in the invention, from the viewpoints of a pigment hue, image storability and image fixing property, it is preferable to use a diazonium salt compound represented by the following formula (2).

(2)

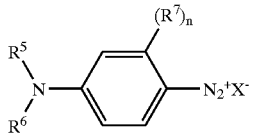

In formula (2), $R^5$ and $R^6$ represent independently, a hydrogen atom, a substituted or unsubstituted alkyl group, or a substituted or unsubstituted aryl group. $R^5$ and $R^6$ may be the same or different, but are not both hydrogen atoms at the same time. $R^7$ represents a hydrogen atom, a substituted or unsubstituted alkyl group, a substituted or unsubstituted aryl group, a substituted or unsubstituted alkoxy group, a substituted or unsubstituted aryloxy group, a substituted or unsubstituted alkylthio group, a substituted or unsubstituted arylthio group, a halogen atom, or a substituted amino group. $X^-$ represents an acid anion, and n represents an integer of 1 to 4. In addition, $R^5$ and $R^6$ may bond to each other to form a ring.

When $R^5$, $R^6$ and $R^7$ are an alkyl group, the alkyl group is preferably an alkyl group having 1 to 30 carbon atoms, which may be straight, branched or cyclic, and which may have a substituent. Examples of the substituent include an aryl group, an alkoxy group, an aryloxy group, a halogen atom, an alkylamino group, an arylamino group, an amino group, a carbamoyl group, a sulfamoyl group, a hydroxyl group, an acyloxy group, an alkoxycarbonyl group, an acylamino group, a cyano group, an amido group, and a sulfonamido group. Further, the substituent may have a substituent. Examples of such a substituted or unsubstituted alkyl group include a methyl group, an ethyl group, a propyl group, a butyl group, a pentyl group, a sec-pentyl group, a hexyl group, a methoxyethyl group, an ethoxyethyl group, and an acetoxyethyl group.

When $R^5$, $R^6$ and $R^7$ are an aryl group, the aryl group is preferably an aryl group having 6 to 30 carbon atoms. Examples thereof include a phenyl group, and a naphthyl group. The aryl group may have a substituent, and examples of the substituent include an alkyl group, an alkoxy group, an aryloxy group, a halogen atom, a carbamoyl group, an alkylamino group, an arylamino group, an amino group, a carbamoyl group, a hydroxyl group, an acyloxy group, an alkoxycarbonyl group, and an acylamino group. Further, the substituent may have a substituent.

When $R^7$ is an alkoxy group, the alkoxy group is preferably an alkoxy group having 1 to 25 carbon atoms. Examples thereof include a methoxy group, an ethoxy group, a hexyloxy group, a 2-ethylhexyloxy group, a 1-ethylpropoxy group, and a dodecyloxy group. The alkoxy group may have a substituent, and examples of the substituent include an aryl group, an alkoxy group, an aryloxy group, a halogen atom, an alkylamino group, an arylamino group, an amino group, a carbamoyl group, a hydroxyl group, an acyloxy group, an alkoxycarbonyl group, and an acylamino group.

When $R^7$ is an aryloxy group, examples thereof include a phenoxy group, and a naphthoxy group. The aryloxy group may have a substituent, and examples of the substituent include an alkyl group, an alkoxy group, an aryloxy group, a halogen atom, an alkylamino group, an arylamino group, an amino group, a carbamoyl group, a hydroxyl group, an acyloxy group, an alkoxycarbonyl group, and an acylamino group.

When $R^7$ is an alkylthio group, the alkylthio group is preferably an alkyl group having 1 to 30 carbon atoms, which may be straight, branched or cyclic, and which may have a substituent. Examples of the substituent include an aryl group, an alkoxy group, an aryloxy group, a halogen atom, an alkylamino group, an arylamino group, an amino group, a carbamoyl group, a hydroxyl group, an acyloxy group, an alkoxycarbonyl group, and an acylamino group. Examples of such a substituted or unsubstituted alkylthio group include a methylthio group, an ethylthio group, a propylthio group, a butylthio group, a pentylthio group, and a sec-pentylthio group.

When $R^7$ is an arylthio group, the arylthio group is preferably an aryl group having 6 to 30 carbon atoms. Examples of such a arylthio group include a phenylthio group, and a naphthylthio group. The arylthio group may have a substituent, and examples of the substituent include an alkyl group, an alkoxy group, an aryloxy group, a halogen atom, a carbamoyl group, an alkylamino group, an arylamino group, an amino group, a carbamoyl group, a hydroxyl group, an acyloxy group, an alkoxycarbonyl group, and an acylamino group. Further, the substituent may have a substituent.

When $R^7$ is a halogen atom, examples thereof include fluorine, chlorine, bromine and iodine.

When $R^7$ is a substituted amino group, examples of a substituent include an alkyl group, an aryl group, an alkoxy group, an alkylcarbonyl group, and an arylsulfonyl group. Examples thereof are the same as those when $R^7$ is an alkyl group or an aryl group. When the substituted amino group has two substituents, these may be the same or different. In addition, the substituted amino group can have a substituent and a hydrogen atom. Further, the substituent may have a substituent.

The benzene ring of a diazonium salt compound represented by formula (2) may have a plurality of groups represented by $R^7$. That is, in the formula (2), n represents an integer of 1 to 4, and is preferably 1 to 2.

In formula (2), examples of X of an acid anion ($X^-$) include a perfluoroalkylcarboxylic acid having 1 to 20 carbon atoms (e.g., perfluorooctanoic acid, perfluorodecanoic acid, and perfluorododecanoic acid), perfluoroalkylsulfonic acid having 1 to 20 carbon atoms (e.g., perfluorooctanesulfonic acid, perfluorodecanesulfonic acid, and perfluorohexadecanesulfonic acid), an aromatic carboxylic acid having 7 to 50 carbon atoms (e.g., 4,4-di-t-butylsalicylic acid, 4-t-octyloxybenzoic acid, 2-n-octyloxybenzoic acid, 4-n-hexadecylbenzoic acid, 2,4-bis-n-octadecyloxybenzoic acid, and 4-n-decylnaphthoic acid), an aromatic sulfonic acid having 6 to 50 carbon atoms (e.g., 1,5-naphthalenedisulfonic acid, 4-t-octyloxybenzenesulfonic acid, and 4-n-dodecylbenzenesulfonic acid), 4,5-di-t-butyl-2-naphthoic acid, borate tetrafluoride, tetraphenylboric acid, and hexafluorophosphoric acid. Among them, a perfluoroalkylcarboxylic acid having 6 to 16 carbon atoms, a perfluoroalkylsulfonic acid having 6 to 16 carbon atoms, an aromatic carboxylic acid having 10 to 40 carbon atoms, an aromatic sulfonic acid having 10 to 40 carbon atoms, borate tetrafluoride, tetraphenylboric acid, and hexafluorophosphoric acid are preferable.

Examples of the diazonium salt compound represented by the formula (2) include the following compounds (exemplified compounds 1 to 70), however the invention is not limited by them at all.

(1)
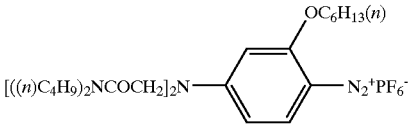
(2)
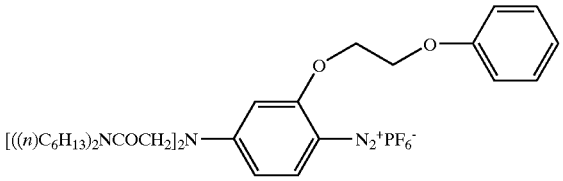
(3)
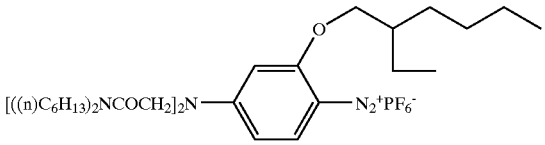
(4)
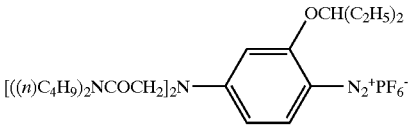
(5)
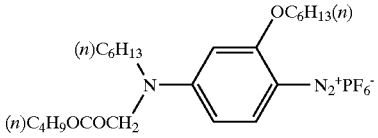
(6)
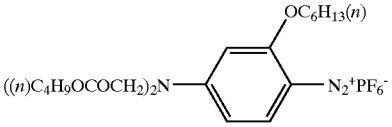
(7)
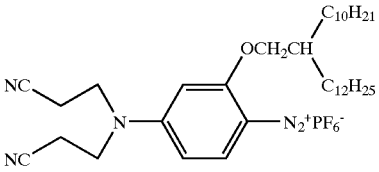
(8)
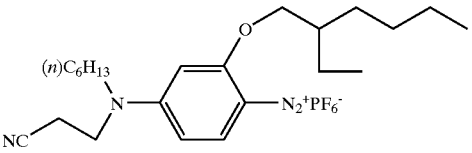
(9)
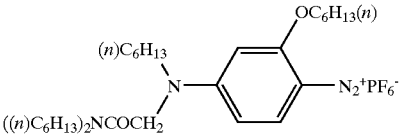
-continued
(10)
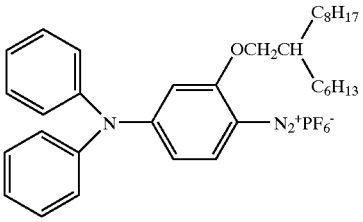
(11)
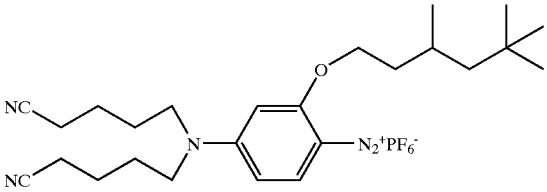
(12)
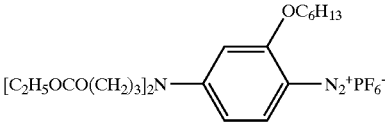
(13)
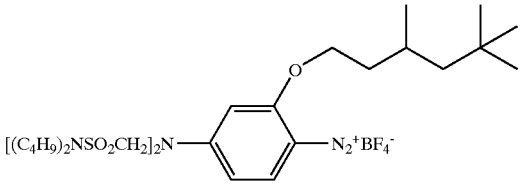
(14)
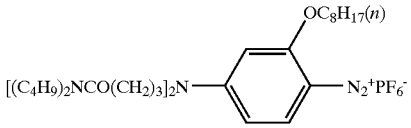
(15)
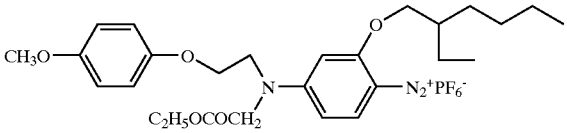
(16)
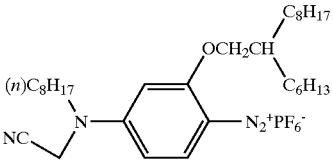
(17)
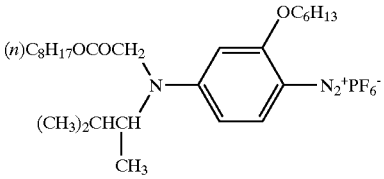
(18)
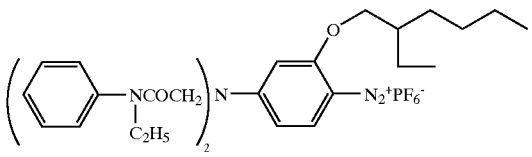

-continued
(19)
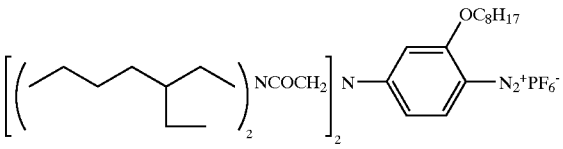
(20)
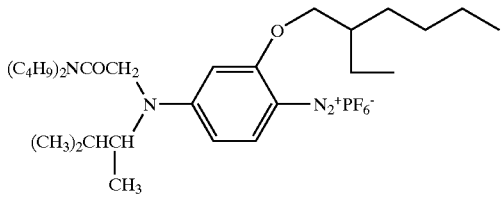
(21)
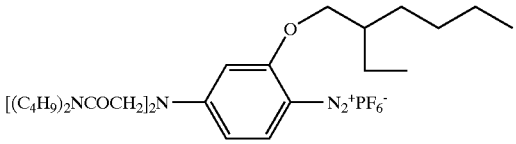
(22)
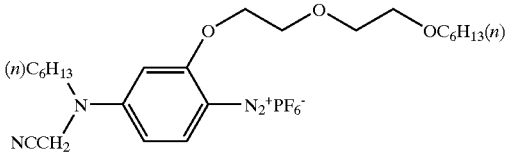
(23)
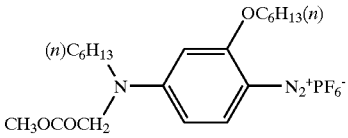
(24)
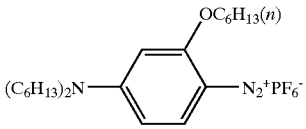
(25)
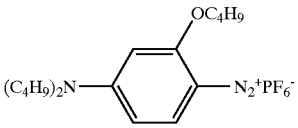
(26)
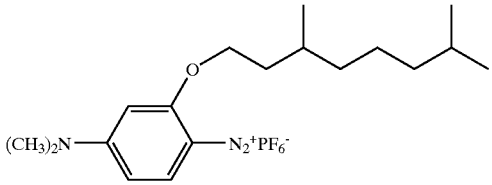
(27)
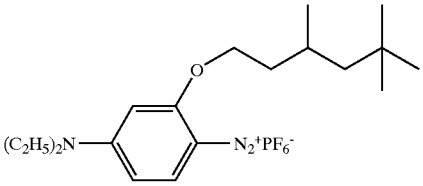
-continued
(28)
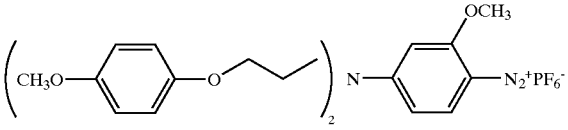
(29)
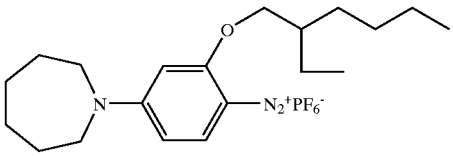
(30)
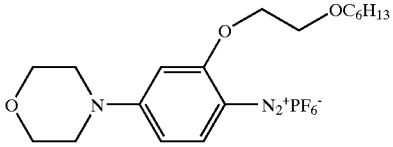
(31)
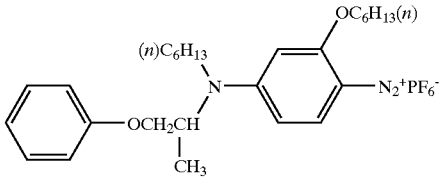
(32)
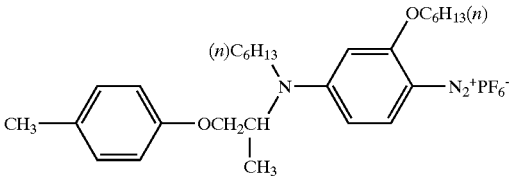
(33)
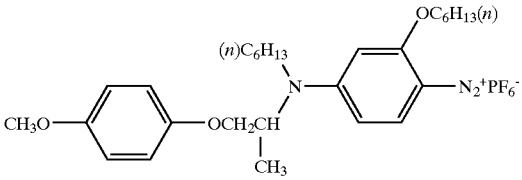
(34)
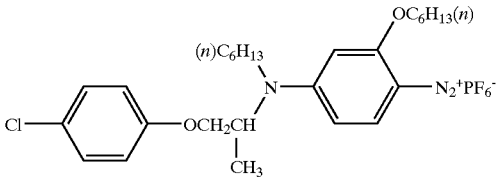
(35)
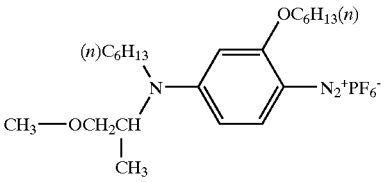

-continued
(36)
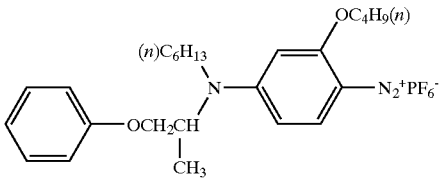
(37)
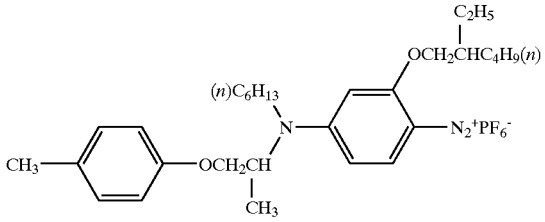
(38)
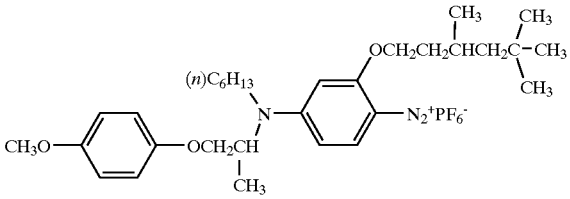
(39)
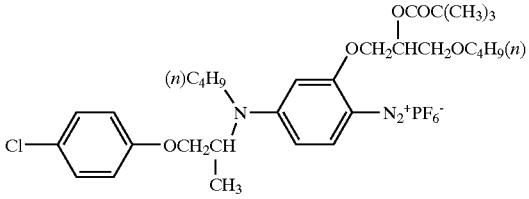
(40)
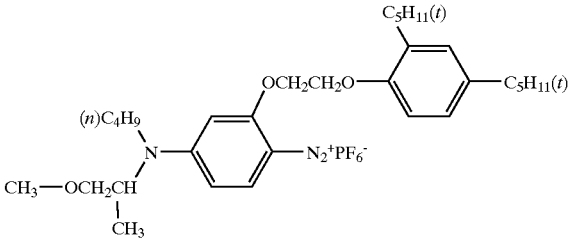
(41)
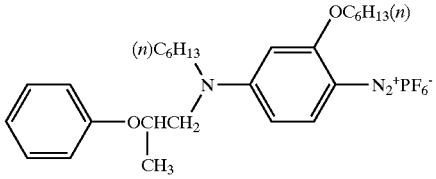
(42)
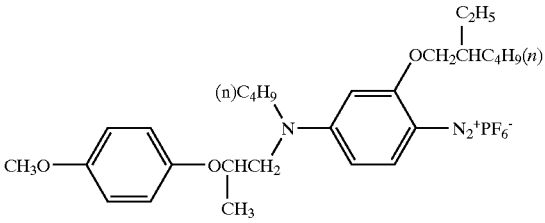
-continued
(43)
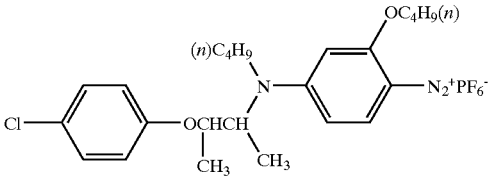
(44)
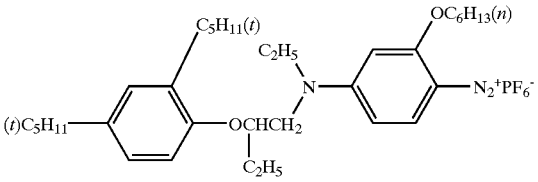
(45)
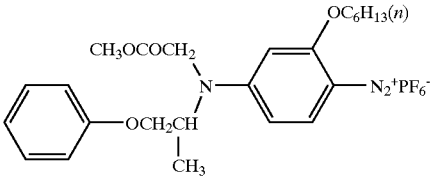
(46)
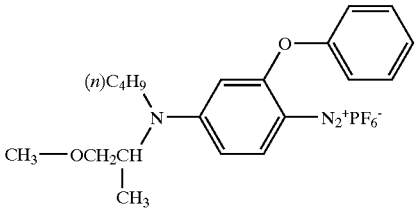
(47)
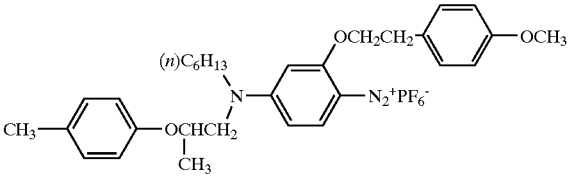
(48)
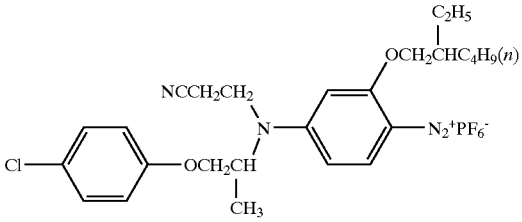
(49)
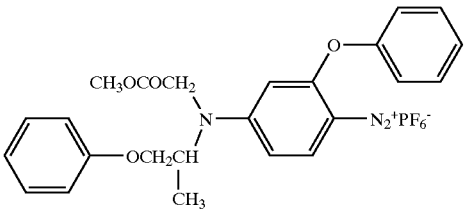

-continued
(50)
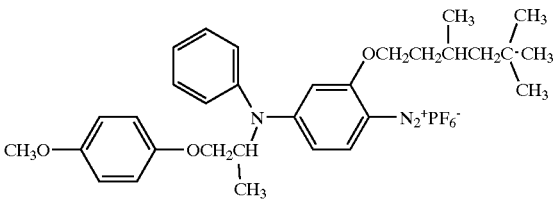
(51)
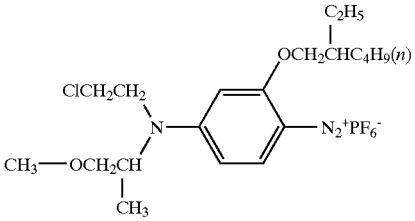
(52)
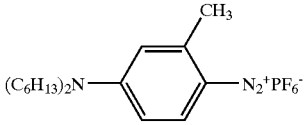
(53)
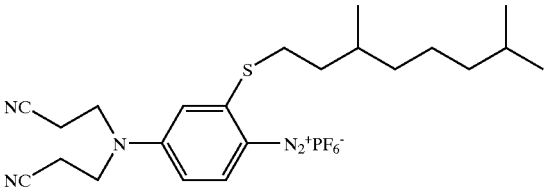
(54)
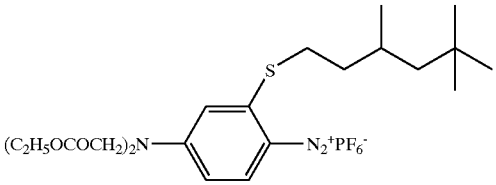
(55)
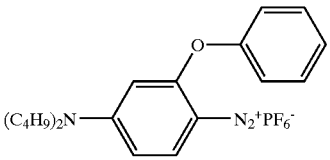
(56)
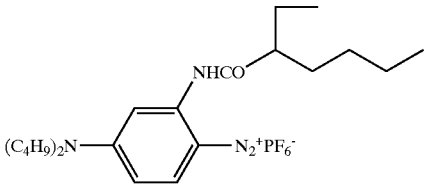
(57)
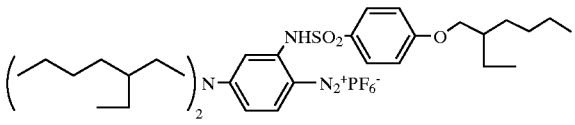
-continued
(58)
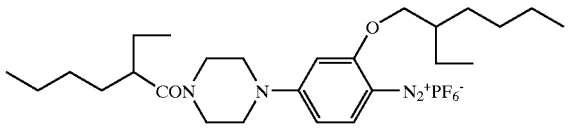
(59)
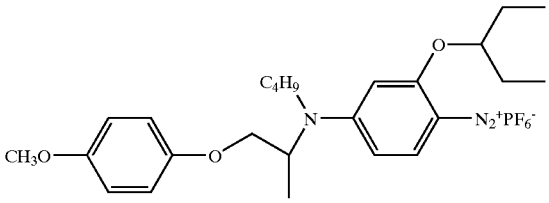
(60)
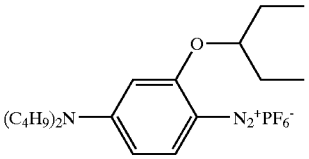
(61)
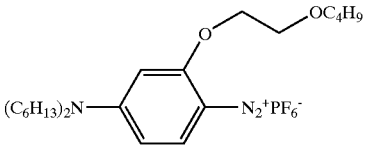
(62)
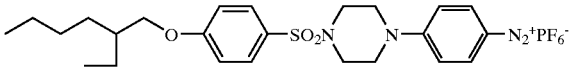
(63)
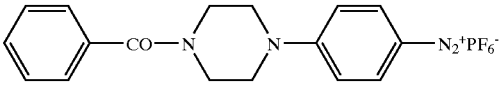
(64)
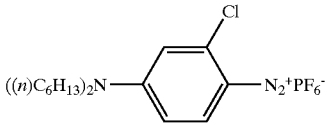
(65)
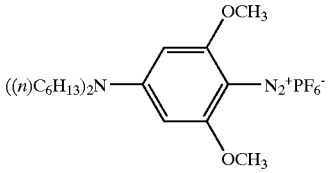
(66)
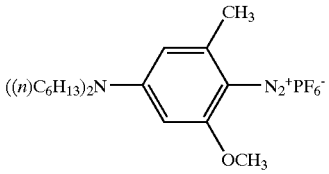
(67)
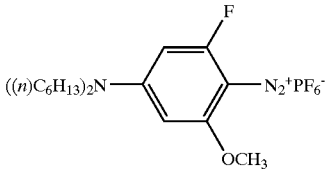

-continued (68)

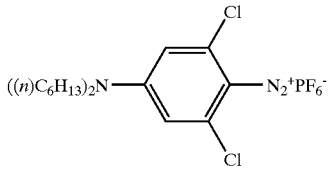

(69)

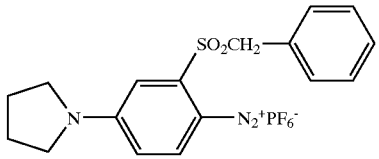

(70)

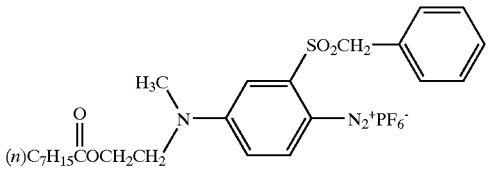

The diazonium salt compounds represented by formula (2) may be used alone, or two or more of these compounds may be used. In addition, the diazonium salt compound represented by formula (2) may be used together with other diazonium salt compound.

Examples of the diazonium salt compound which can be used together with that represented by formula (2) include 4-(p-tolylthio)-2,5-dibutoxybenzene diazonium, 4-(4-chlorophenylthio)-2,5-dibutoxybenzene diazonium, 4-(N,N-dimethylamino)benzene diazonium, 4-(N,N-diethylamino) benzene diazonium, 4-(N,N-dipropylamino)benzene diazonium, 4-(N-methyl-N-benzylamino)benzene diazonium, 4-(N,N-dibenzylamino)benzene diazonium, 4-(N-ethyl-N-hydroxyethylamino)benzene diazonium, 4-(N,N-diethylamino)-3-methoxybenzene diazonium, 4-(N,N-dimethylamino)-2-methoxybenzene diazonium, 4-(N-benzoylamino)-2,5-diethoxybenzene diazonium, 4-morpholino-2,5-dibutoxybenzene diazonium, 4-anilinobenzene diazonium, 4-[N-(4-methoxybenzoyl) amino]-2,5-diethoxybenzene diazonium, 4-pyrrolidino-3-ethylbenzene diazonium, 4-[N-(1-methyl-2-(4-methoxyphenoxy)ethyl)-N-hexylamino]-2-hexyloxybenzene diazonium, 4-[N-(2-(4-methoxyphenoxy) ethyl)-N-hexylamino]-2-hexyloxybenzene diazonium, and 2-(1-ethylpropyloxy)-4-[di-(di-n-butylaminocarbonylmethyl)amino]benzene diazonium.

These may be used alone without using the diazonium salt compound represented by formula (2) jointly.

The amount of the diazonium salt compound contained in a recording layer of the heat-sensitive recording material of the invention is preferably 0.02 to 3 g/m$^2$, and more preferably 0.1 to 2 g/m$^2$.

Here, the heat-sensitive recording layer in the invention preferably contains the diazonium salt compound in microcapsules.

In order to stabilize the diazonium salt, the diazonium salt may form a complex compound with zinc chloride, cadmium chloride, tin chloride or the like.

The diazonium salt develops a color by reacting with a coupler described below.

Coupler

The coupler (coupling component) which can be used in the heat-sensitive recording material of the invention will be explained.

As the coupler, any compound may be used as long as it coupling-reacts with the diazonium salt in a basic atmosphere or a neutral atmosphere to form a dye. So-called four-equivalent couplers for a silver halide photographic photosensitive material can be all used as the coupler. These can be selected depending on a desired hue. Examples thereof include so-called an active methylene compound having a methylene group adjacent to a carbonyl group, a phenol derivative and a naphthol derivative. Specific examples thereof are shown below. The coupler is used in the range corresponding to the object of the invention.

Examples of the coupler include resorcin, fluoroglycine, 2,3-dihydroxynaphthalene, sodium 2,3-dihydroxynaphthalene-6-sulfonate, 1-hydroxy-2-naphthoic acid morpholinopropylamide, sodium 2-hydroxy-3-naphthalenesulfonate, 2-hydroxy-3-naphthalenesulfonic acid anilide, 2-hydroxy-3-naphthalenesulfonic acid morpholinopropylamide, 2-hydroxy-3-naphthalenesulfonic acid-2-ethylhexyloxypropylamide, 2-hydroxy-3-naphthalenesulfonic acid-2-ethylhexylamide, 5-acetamide-1-naphthol, sodium 1-hydroxy-8-acetamidenaphthalene-3,6-disulfonate, 1-hydroxy-8-acetamidenaphthalene-3,6-disulfonic acid dianilide, 1,5-dihydroxynaphthalene, 2-hydroxy-3-naphthoic acid morpholinopropylamide, 2-hydroxy-3-naphthoic acid octylamide, 2-hydroxy-3-naphthoic acid anilide, 5,5-dimethyl-1,3-cyclohexanedione, 1,3-cyclopentanedione, 5-(2-n-tetradecyloxyphenyl)-1,3-cyclohexanedione, 5-phenyl-4-methoxycarbonyl-1,3-cyclohexanedione, 5-(2,5-di-n-octyloxyphenyl)-1,3-cyclohexanedione, N,N'-dicyclohexylbarbituric acid, N,N'-di-n-dodecylbarbituric acid, N-n-octyl-N'-n-octadecylbarbituric acid, N-phenyl-N'-(2,5-di-n-octyloxydiphenyl)barbituric acid, N,N'-bis (octadecyloxycarbonylmethyl)barbituric acid, 1-phenyl-3-methyl-5-pyrazolone, 1-(2,4,6-trichlorophenyl)-3-anilino-5-pyrazolone, 1-(2,4,6-trichlorophenyl)-3-benzamido-5-pyrazolone, 6-hydroxy-4-methyl-3-cyano-1-(2-ethylhexyl)-2-pyridone, 2,4-bis-(benzoylacetamido)toluene, 1,3-bis-(pivaloylacetamidomethyl)benzene, benzoylacetonitrile, thenoylacetonitrile, acetoacetanilide, benzoylacetanilide, pivaloylacetanilide, 2-chloro-5-(N-n-butylsulfamoyl)-1-pivaloylacetamidobenzene, 1-(2-ethylhexyloxypropyl)-3-cyano-4-methyl-6-hydroxy-1,2-dihydropyridine-2-one, 1-(dodecyloxypropyl)-3-acetyl-4-methyl-6-hydroxy-1,2-dihydropyridine-2-one, and 1-(4-n-octyloxyphenyl)-3-tert-butyl-5-aminopyrazole.

The details of the coupler are described in JP-A Nos. 4-201483, 7-223367, 7-223368, 7-323660, 7-125446, 7-96671, 7-223367, 7-223368, 9-156229, 9-216468, 9-216469, 9-203472, 9-319025, 10-35113, 10-193801, and 10-264532, and Japanese Patent Application No. 8-030799.

Among the aforementioned compounds, a compound represented by the following formula (3) and a tautomer thereof are preferable.

$$E^1—CH_2—E^2 \qquad \text{Formula (3)}$$

Here, $E^1$ and $E^2$ represent independently an electron attractive group, and $E^1$ and $E^2$ may bond to each other to form a ring.

The electron attractive group represented by $E^1$ or $E^2$ means a substituent having a positive Hammett substituent constant $\sigma_p$, and these may be the same or different. Examples thereof include acyl groups such as an acetyl group, a propionyl group, a pivaloyl group, a chloroacetyl group, a trichloroacetyl group, a trifluoroacetyl group, a 1-methylcyclopropylcarbonyl group, a 1-ethylcyclopropylcarbonyl group, a 1-benzylcyclopropylcarbonyl group, a benzoyl group, a 4-methoxybenzyl group, and a thenoyl group; oxycarbonyl groups such as methoxycarbonyl group, an ethoxycarbonyl group, a 2-methoxyethoxycarbonyl group, and a 4-methoxyphenoxycarbonyl group; carbamoyl groups such as a carbomoyl group, a N,N-dimethylcarbamoyl group, a N,N-diethylcarbamoyl group, a N-phenylcarbamoyl group, a N-[2,4-bis(pentyloxy)phenyl]carbamoyl group, a N-[2,4-bis(octyloxy)phenyl]carbamoyl group, and a morpholinocarbonyl group; alkylsulfonyl groups and arylsulfonyl groups such as a methanesulfonyl group, a benzenesulfonyl group, and a toluenesulfonyl group; phosphono groups such as a diethylphosphono group; heterocyclic groups such as a benzoxazol-2-yl group, a benzothiazol-2-yl group, a 3,4-dihydroquinazoline-4-one-2-yl group, and a 3,4-dihydroquinazoline-4-sulfon-2-yl group; a nitro group; an imino group; and a cyano group.

Alternatively, both of electron attractive groups represented by $E^1$ and $E^2$ may bond to each other to form a ring. Such a ring to be formed is preferably 5-membered or 6-membered carbocycles or heterocycles.

Furthermore, among compounds represented by formula (3) compounds represented by the following formula (4) are particularly preferable.

Formula (4)

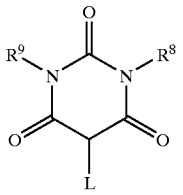

In the formula (4), $R^8$ and $R^9$ represent independently a hydrogen atom, an alkyl group or an aryl group.

The alkyl group represented by $R^8$ or $R^9$ may be unsubstituted or substituted. When the alkyl group have a substituent, suitable examples of the substituent include a phenyl group, a halogen atom, an alkoxy group, an aryloxy group, an alkoxycarbonyl group, an acyloxy group, an acylamino group, a carbamoyl group, a cyano group, an alkylsulfonyl group, an arylsulfonyl group, a sulfonamido group, a sulfamoyl group, an acyl group, and a heterocyclic group.

As the alkyl group represented by $R^8$ and $R^9$, an alkyl group having 1 to 30 carbon atoms is preferable, and an alkyl group having 10 to 25 carbon atoms is more preferable. Typical examples thereof include a methyl group, an ethyl group, a propyl group, an isopropyl group, a butyl group, a 1,1-dimethylethyl group, a hexyl group, an octyl group, a 2-ethylhexyl group, a 3,5,5-trimethylhexyl group, a dodecyl group, a cyclohexyl group, a benzyl group, an α-methylbenzyl group, an allyl group, a 2-chloroethyl group, a 2-methoxyethyl group, a 2-ethoxyethyl group, a 2-phenoxyethyl group, a 2-(2,5-di-tert-amylphenoxy)ethyl group, a 3-octyloxypentyl group, a 2-benzoyloxyethyl group, a methoxycarbonylmethyl group, an ethoxycarbonylmethyl group, a methoxycarbonylethyl group, a butoxycarbonylethyl group, an octyloxycarbonylmethyl group, an octadecyloxycarbonyl group, a 2-isopropyloxyethyl group, a 2-methanesulfonylethyl group, a 1-(4-methoxyphenoxy)-2-propyl group, a trichloromethyl group, and a trifluoromethyl group.

Inter alia, a 2-ethylhexyl group, a 3,5,5-trimethylhexyl group, a 2-(2,5-di-tert-amylphenoxy)ethyl group, a 2-benzoyloxyethyl group, a methoxycarbonylmethyl group, an ethoxycarbonylmethyl group, a methoxycarbonylethyl group, a butoxycarbonylethyl group, an octyloxycarbonylmethyl group, an octadecyloxycarbonyl group, a 2-isopropyloxyethyl group, and a 1-(4-methoxyphenoxy)-2-propyl group are preferable.

The aryl group represented by $R^8$ and $R^9$ may be unsubstituted or substituted. When the aryl group has a substituent, typical examples of the substituent include an alkyl group, a phenyl group, a halogen atom, an alkoxy group, an aryloxy group, an alkoxycarbonyl group, an acyloxy group, an acylamino group, a carbamoyl group, a cyano group, an alkylsulfonyl group, an arylsulfonyl group, a sulfonamido group, a sulfamoyl group, an acyl group, and a heterocyclic group.

As the aryl group represented by $R^8$ and $R^9$, an aryl group having 1 to 30 carbon atoms is preferable, and an aryl group having 10 to 25 carbon atoms is more preferable. Examples thereof include a phenyl group, a 2-methylphenyl group, a 3-methylphenyl group, a 4-methylphenyl group, a 2-phenylphenyl group, a 4-phenylphenyl group, a 2-chlorophenyl group, a 4-chlorophenyl group, a 4-bromophenyl group, a 2-methoxyphenyl group, a 2-butoxyphenyl group, a 2-(2-ethylhexyloxy)phenyl group, a 3-hexyloxyphenyl group, a 4-ethoxyphenyl group, a 4-hexyloxyphenyl group, a 4-(3,5,5-trimethylhexyloxy)phenyl group, a 2-phenoxyphenyl group, a 4-phenoxyphenyl group, a 2-methoxycarbonylphenyl group, a 4-ethoxycarbonylphenyl group, a 3-butoxycarbonylphenyl group, a 2-acetamidophenyl group, a 4-acetamidophenyl group, a 4-cyanophenyl group, a 2-octylsulfonylphenyl group, a 4-octylsulfonylphenyl group, a 2-dibutylaminocarbamoylphenyl group, a 4-dibutylaminocarbamoylphenyl group, a 4-cyclohexylphenyl group, a 2,5-dioctyloxyphenyl group, a 2,4-dihexyloxyphenyl group, and a 2,3-dimethoxyphenyl group.

Inter alia, a phenyl group, a 2-methylphenyl group, a 3-methylphenyl group, a 4-methylphenyl group, a 2-chlorophenyl group, a 4-chlorophenyl group, a 2-methoxyphenyl group, a 2-butoxyphenyl group, a 2-(2-ethylhexyloxy)phenyl group, a 3-hexyloxyphenyl group, a 4-ethoxyphenyl group, a 4-hexyloxyphenyl group, a 4-(3,5,5-trimethylhexyloxy)phenyl group, a 2-methoxycarbonylphenyl group, a 4-ethoxycarbonylphenyl group, a 3-butoxycarbonylphenyl group, a 2-acetamidophenyl group, a 4-acetamidophenyl group, a 2-dibutylaminocarbamoylphenyl group, a 4-dibutylaminocarbamoylphenyl group, a 4-cyclohexylphenyl group, a 2,5-dioctyloxyphenyl group, and a 2,4-dihexyloxyphenyl group are preferable.

In formula (4), L represents a hydrogen atom, or a substituent which can leave at the time of coupling reaction with a diazonium salt (hereinafter, simply referred to as "leaving group").

One leaving group may be introduced into the compound represented by formula (4) as a substituent or at least two leaving groups may be introduced. Examples of the leaving group include a halogen atom, an aromatic azo group, an alkyl group which bonds to a coupling site via an oxygen, nitrogen, sulfur or carbon atom, an aryl group, a heterocyclic group, an alkylsulfonyl group, an arylsulfonyl group, an arylsulfinyl group, an alkylcarbonyl group, an arylcarbonyl group, a heterocyclic carbonyl group, and a heterocyclic group which bonds to a coupling site via a nitrogen atom.

Examples thereof include a halogen atom, an alkoxy group, an aryloxy group, an acyloxy group, an alkylsulfonyloxy group, an arylsulfonyloxy group, an acylamino group, an alkylsulfonamido group, an arylsulfonamido group, an alkoxycarbonyloxy group, an aryloxycarbonyloxy group, an alkylthio group, an arylthio group, a heterocyclic thio group, a carbamoylamino group, an arylsulfinyl group, an arylsulfonyl group, a 5-membered or 6-membered nitrogen-containing heterocyclic group, an imido group, and an arylazo group. Further, an alkyl group or a heterocyclic group contained in these leaving groups may have a substituent such as an alkoxy group, an aryloxy group, a halogen atom, an alkoxycarbonyl group, or an alkylcarbonyloxy group.

In addition, the leaving group can also be an amino group, an ether group, and a thioether group which bond to a coupling site via a carbon atom. Specific examples thereof include a dimethylaminomethyl group, a hydroxymethyl group, an ethoxymethyl group, a phenoxymethyl group, a methylthioxymethyl group, and a phenylthioxymethyl group.

When the leaving group has at least two substituents, the substituents may be the same or different, and these substituents may have further the aforementioned substituent. Moreover, the leaving group and a coupler nucleus may form a ring.

Specific examples of the leaving group are as follows. Examples of the halogen atom include fluorine, bromine, chlorine and iodine. Examples of the alkoxy group include an ethoxy group, a dodecyloxy group, a methoxyethylcarbamoylmethoxy group, a carboxypropyloxy group, a methylsulfonylethoxy group, and an ethoxycarbonylmethoxy group. Examples of the aryloxy group include a 4-methylphenoxy group, a 4-chlorophenoxy group, a 4-methoxyphenoxy group, a 4-carboxyphenoxy group, a 3-ethoxycarboxyphenoxy group, a 3-acetylaminophenoxy group, and a 2-carboxyphenoxy group. Examples of the acyloxy group include an acetoxy group, a tetradecanoyloxy group, and a benzoyloxy group. Examples of the alkylsulfonyloxy group and arylsulfonyloxy group include a methanesulfonyloxy group, and a toluenesulfonyloxy group. Examples of the acylamino group include a dichloroacetylamino group, and a heptafluorobutyrylamino group. Examples of the alkylsulfonamido group and arylsulfonamido group include a methanesulfonamido group, a trifluoromethanesulfonamido group, and a p-toluenesulfonylamido group.

Examples of the alkoxycarbonyloxy group include an ethoxycarbonyloxy group, and a benzyloxycarbonyloxy group. Examples of the alkylthio group, arylthio group and heterocyclic thio group include an ethylthio group, a 2-carboxyethylthio group, a dodecylthio group, a 1-carboxydodecylthio group, a phenylthio group, a 2-butoxy-t-octylphenylthio group, and a tetrazolylthio group. Examples of the arylsulfonyl group include a 2-butoxy-t-octylphenylsulfonyl group, and examples of the arylsulfinyl group include a 2-butoxy-t-octylphenylsulfinyl group. Examples of the carbamoylamino group include a N-methylcarbamoylamino group, and a N-phenylcarbamoylamino group. Examples of the 5-membered or 6-membered nitrogen-containing heterocyclic group include an imidazolyl group, a pyrazolyl group, a triazolyl group, a tetrazolyl group, and a 1,2-dihydro-2-oxo-1-pyridyl group. Examples of the imido group include a succinimido group, and a hydantoinyl group. Examples of the arylazo group include a phenylazo group, and a 4-methoxyphenylazo group. These groups may be further substituted.

Specific examples of couplers represented by formula (3) or (4) (exemplified compounds B-1 to B-44) are shown below. However, the invention is not limited by them.

B-1

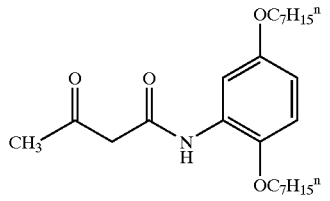

B-2

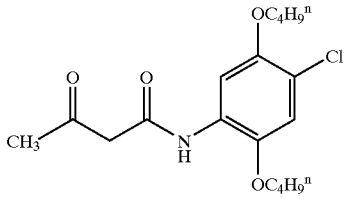

B-3

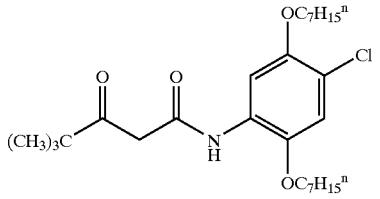

B-4

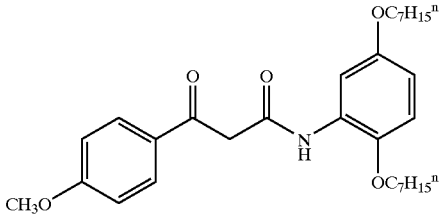

B-5

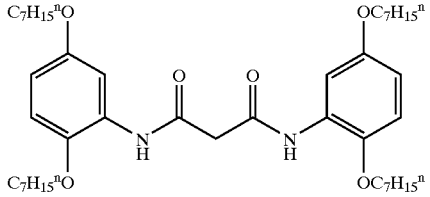

B-6

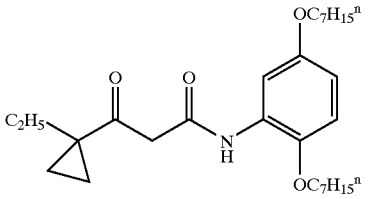

B-7

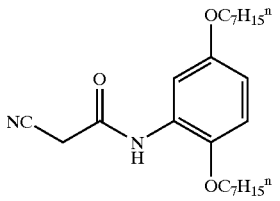

-continued
B-8
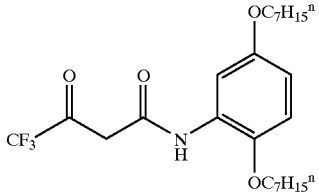
B-9
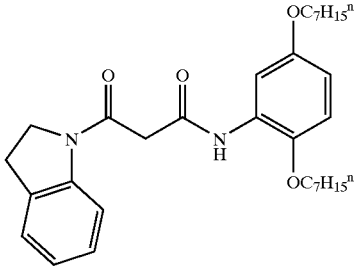
B-10
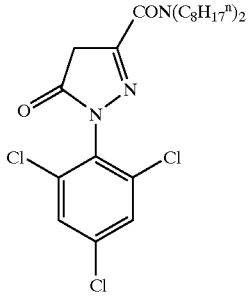
B-11
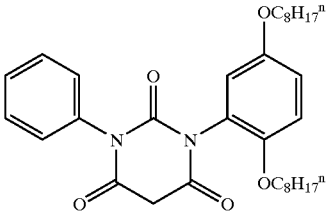
B-12
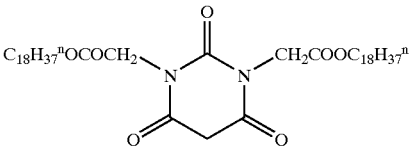
B-13
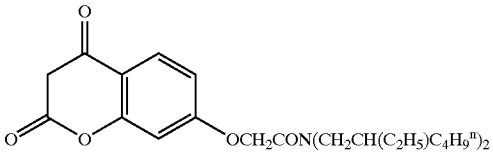
B-14
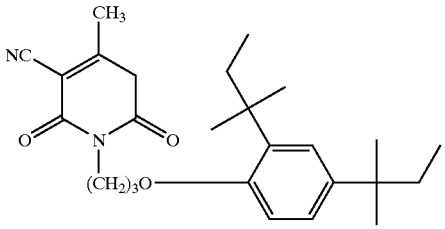
-continued
B-15
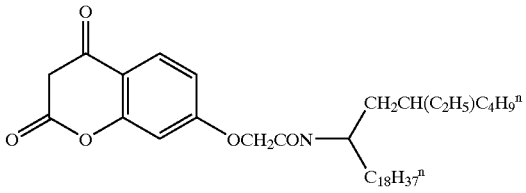
B-16
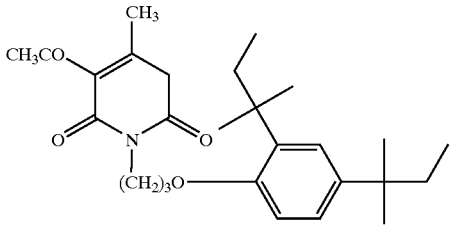
B-17
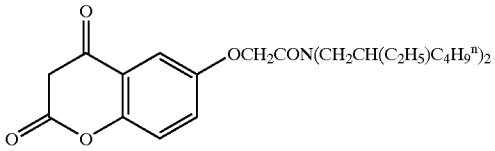
B-18
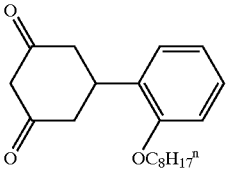
B-19
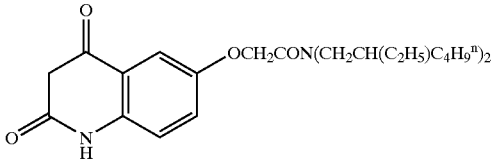
B-20
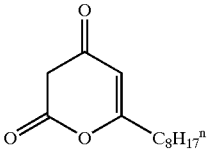
B-21
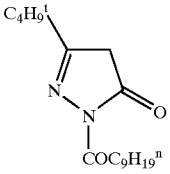
B-22
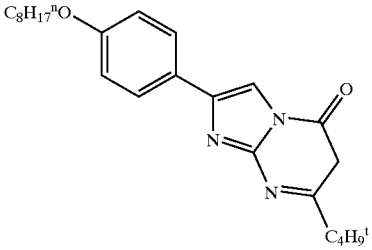

-continued
B-23
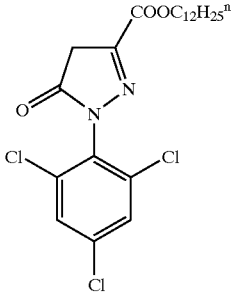
B-24
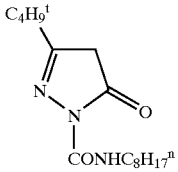
B-25
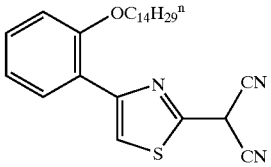
B-26
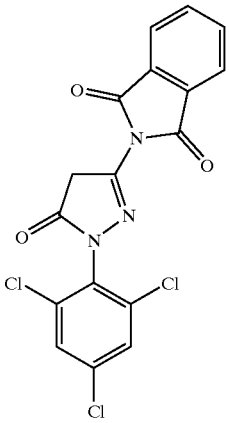
B-27
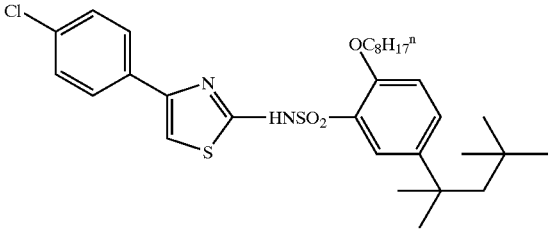
B-28
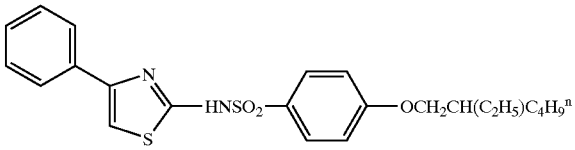
-continued
B-29
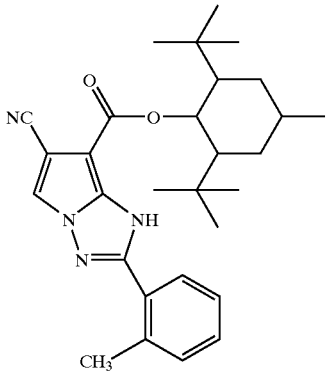
B-30
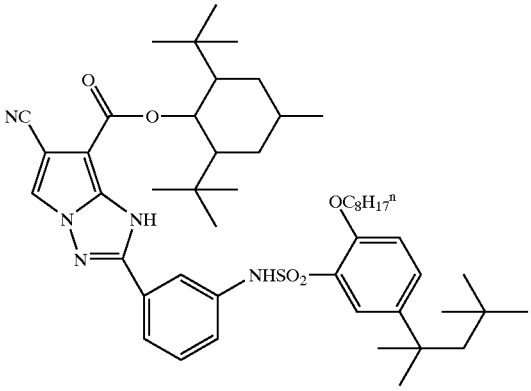
B-31
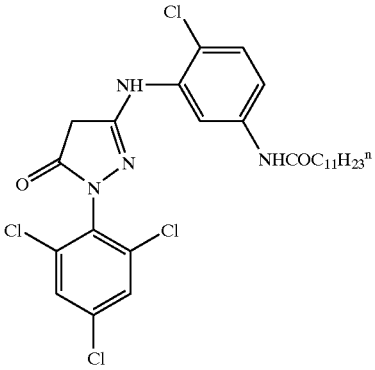
B-32
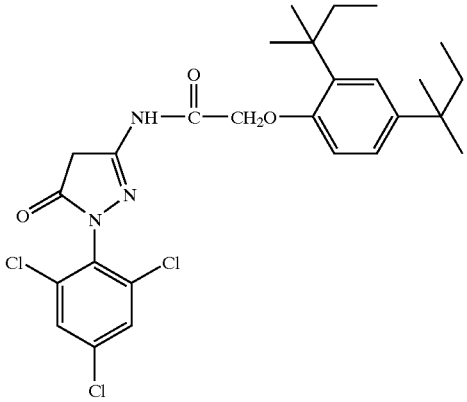

-continued

B-33

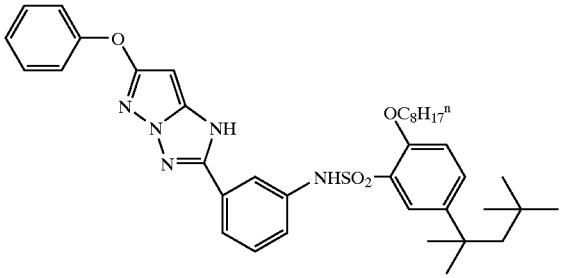

B-34

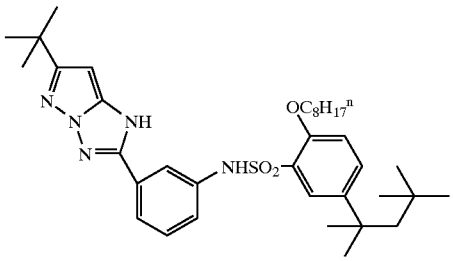

B-35

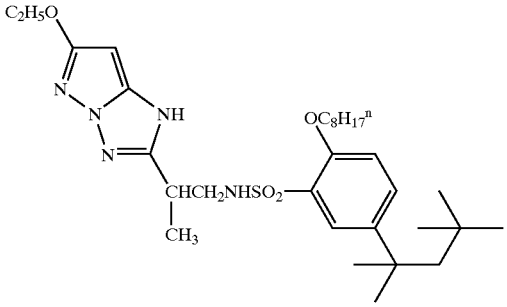

B-36

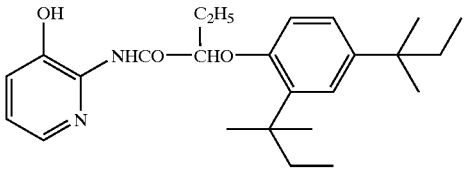

B-37

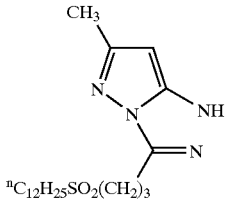

B-38

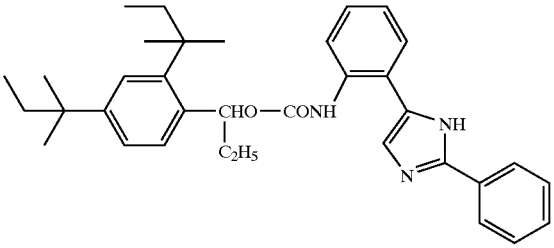

-continued

B-39

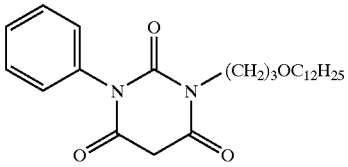

B-40

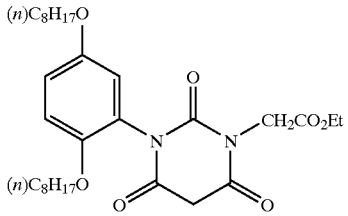

B-41

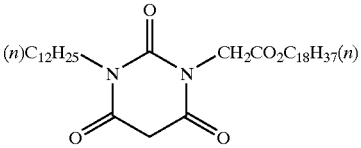

B-42

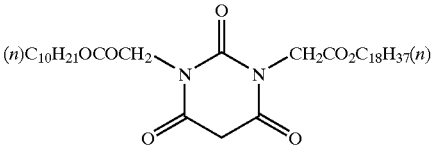

B-43

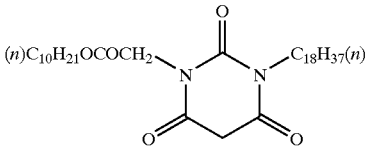

B-44

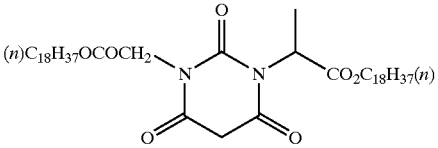

The tautomer of the above-mentioned coupler is a compound which exists as an isomer of the coupler, whose structure easily changes into that of the above-mentioned coupler and into the structure of which that of the above-mentioned coupler easily changes. The tautomer is also preferable as the coupler used in the invention.

<Microcapsulation>

In the heat-sensitive recording material of the invention, in order to enhance raw stock storability thereof, it is preferable that the diazonium salt is encapsulated in microcapsules.

A method of forming microcapsules can be appropriately selected from known methods.

Since it is necessary for a polymer material which forms capsule walls of microcapsules to be not permeated by compounds in or out of the microcapsules at a normal temperature, and to be permeated when heated, the polymer material preferably has a glass transition temperature of 60 to 200° C. Examples thereof include polyurethane, polyurea, polyamide, polyester, urea/formaldehyde resin, melamine resin, polystyrene, styrene-methacrylate copolymer, styrene-acrylate copolymer, and a mixture thereof.

As a specific method for microcapsulation, an interface polymerization method and an internal polymerization method are preferable. The details of these microcapsulating methods and examples of reactants are described in U.S. Pat. Nos. 3,726,804, and 3,796,669. For example, when polyurea or polyurethane is used as a capsule wall material, polyisocyanate and a second substance which reacts therewith to form a capsule wall (e.g., polyol or polyamine) are added to an aqueous medium or an oily medium to be capsulated, emulsified and dispersed in water and then heated to cause a polymer forming reaction at an oil droplet interface and to form a microcapsule wall. Even if addition of the second substance is omitted, polyurea may be produced.

Inter alia, it is preferable that the polymer substance for forming the capsule wall includes at least one kind of polymers having urethane and/or urea as a component (e.g., polyurethane, or polyurea).

One example of a process for preparing microcapsules (polyurea/polyurethane wall) encapsulating the diazonium salt will be explained below.

First, the aforementioned diazonium salt is dissolved or dispersed in a hydrophobic organic solvent (hydrophobic solvent) which is to be the core of a microcapsule, to form an oil phase. Here, all of the diazonium salts are contained in the same oil phase and a polyvalent isocyanate is added to the oil phase as a wall material.

The hydrophobic organic solvent which dissolves and disperses the diazonium salt in preparation of the oil phase preferably has a boiling point of 100 to 300° C., and examples thereof include alkylnaphthalene, alkyldiphenylethane, alkyldiphenylmethane, alkylbiphenyl, alkylterphenyl, chlorinated paraffin, phosphates, maleates, adipates, phthalates, benzoates, carbonates, ethers, sulfates, and sulfonates. These may be used alone or in combination.

When the solubility of the diazonium salt to be capsulated in the aforementioned organic solvent is low, a low boiling point solvent in which the solubility of the diazonium salt to be used is high may be used supplementaly. Examples of the low boiling point solvent include ethyl acetate, propyl acetate, isopropyl acetate, butyl acetate, methylene chloride, tetrahydrofuran, acetonitrile, and acetone.

Meanwhile, an aqueous solution in which a water-soluble polymer is dissolved is employed as an aqueous phase, and the aforementioned oil phase is added to the aqueous phase. Emulsification and dispersion are performed with a homogenizer or the like. The water-soluble polymer makes dispersion uniform and easy and acts as a dispersing medium for stabilizing the emulsification-dispersed aqueous solution. Here, In order to make emulsification-dispersion more uniform and stable, a surfactant may be added to at least one of the oil phase and the aqueous phase. As the surfactant, known surfactants for emulsification may be employed. The amount of the surfactant to be added is preferably 0.1 to 5% by mass, and more preferably 0.5 to 2% by mass relative to the mass of the oil phase.

The water-soluble polymer which is used in an aqueous water-soluble polymer solution for dispersing the prepared oil phase is preferalby one having a solubility of at least 5% in water at a temperature at which emulsification is performed. Examples thereof include polyvinyl alcohol and a modified product thereof, a polyacrylic acid amide and a derivative thereof, an ethylene-vinyl acetate copolymer, a styrene-maleic acid anhydride copolymer, an ethylene-maleic acid anhydride copolymer, an isobutylene-maleic acid anhydride copolymer, a polyvinylpyrrolidone, an ethylene-acrylic acid copolymer, a vinyl acetate-acrylic acid copolymer, carboxymethylcellulose, methylcellulose, casein, gelatin, starch derivative, gum arabic, and sodium alginate.

It is preferable that the water-soluble polymer has no or little reactivity with the isocyanate compound. It is preferable that a water-soluble polymer having a reactive amino group in a molecular chain thereof such as gelatin is modified in advance to lose reactivity thereof.

The polyvalent isocyanate compound is preferably a compound having a tri-or more-functional isocyanate group, but a difunctional isocyanate compound may be used. Specific examples thereof include a dimer and a trimer (biuret and isocyanurate) of diisocyanate such as xylene diisocyanate and a hydrogenated product thereof, hexamethylene diisocyanate, tolylene diisocyanate and a hydrogenated product thereof, isophorone diisocyanate, a polyfunctional adduct of a polyol such as trimethylolpropane and a difunctional isocyanate such as xylylene diisocyanate, a compound in which a high-molecular compound such as polyether having active hydrogen such as polyethylene oxide is introduced into an adduct of polyol such as trimethylolpropane and difunctional isocyanate such as xylylene diisocyanate, and a formalin-condensate of benzene isocyanate.

Compounds described in JP-A Nos. 62-212190, 4-26189, 5-317694, and 10-114153 are preferable as the polyvalent isocyanate compound.

The amount of polyvalent isocyanate to be used is determined so that the average diameter of microcapsules becomes 0.3 to 12 $\mu$m and that the thickness of a wall becomes 0.01 to 0.3 $\mu$m. In addition, the diameter of dispersed particles thereof is generally about 0.2 to about 10 $\mu$m.

In an emulsified dispersion liquid in which the oil phase is added to the aqueous phase, a polymerization reaction of the polyvalent isocyanate is generated at an interface between the oil phase and the aqueous phase, to form a polyurea wall.

When at least one of polyol and polyamine is further added to the aqueous phase or the hydrophobic solvent of the oil phase, it is reacted with the polyvalent isocyanate and becomes one of components constituting a microcapsule wall. In the aforementioned reaction, in order to enhance a reaction rate, it is preferable to keep a reaction temperature high or add a suitable polymerization catalyst to the reaction system.

Examples of the polyol and polyamine include propylene glycol, glycerin, trimethylolpropane, triethanolamine, sorbitol, and hexamethylenediamine. When a polyol is added to the reaction system, a polyurethane wall is formed.

The polyvalent isocyanate, polyol, reaction catalyst, and, as one of wall forming components, polyamine are described in books (Polyurethane Handbook, edited by Keiji Iwata, The Nikkan Kogyo Shimbun, Ltd. (1987)).

Emulsification can be performed with a known emulsifying machine such as a homogenizer, Manton-Gaulin, an ultrasonic dispersing machine, a dissolver, or a keddy mill. After emulsification, the resultant emulsion is heated to 30 to 70° C. in order to promote a capsule wall-forming reaction. In addition, in order to prevent aggregation of capsules, it is necessary to add water to the reaction system during the reaction to decrease a probablity of collision between capsules, or to sufficiently stir the reaction system.

Alternatively, a dispersing material for preventing aggregation may be added to the reaction system during the reaction. As a polymerization reaction progresses, generation of a carbonic gas is observed. When the generation has been completed, it can be thought that the capsule wall-forming reaction has almost completed. When the polyisocyanate and the like is reacted for a few hours, the desired diazonium salt-encapsulated microcapsule can usually be obtained.

Next, although the coupler used in the invention, the water-soluble polymer, an organic base, and a color developing auxiliary are solid-dispersed with a sand mill or the like, the coupler is particularly preferably used as an emulsified dispersion obtained by dissolving the coupler in advance in a high boiling point organic solvent which is hardly soluble or insoluble in water, mixing the resultant solution with the aqueous polymer solution (aqueous phase) containing the surfactant and/or the water-soluble polymer as a protective colloid, and emulsifying the resultant mixture with a homogenizer or the like. In this case, if necessary, a low boiling point solvent may be used as a dissolution aid. Furthermore, the coupler and the organic base may be emulsification-dispersed separately, or may be mixed, dissolved in a high boiling point organic solvent, and emulsification-dispersed in the aqueous phase. The diameter of emulsified particles is preferably 1 μm or smaller.

It is preferable that the amount of the coupler to be used is 0.1 to 30 parts by mass relative to 1 part by mass of the diazonium salt.

The high boiling point organic solvent used in this case can be appropriately selected from high boiling point oils described, for example, in JP-A No. 2-141279. Inter alia, from the viewpoint of the stability of an emulsified dispersion, esters are preferable, and tricresyl phosphate is particularly preferable. It is also possible to use a plurality of the aforementioned oils, or use the aforementioned oil together with other oil.

A low boiling point auxiliary solvent as a dissolution aid may be further added to the organic solvent, and suitable examples of the low boiling point solvent include ethyl acetate, isopropyl acetate, butyl acetate and methylene chloride. Depending on a circumstance, it is also possible to use the low boiling point solvent without using the high boiling point oil.

In addition, the water-soluble polymer to be contained in the aqueous phase as a protective colloid can be appropriately selected from known anionic polymers, nonionic polymers and amphoteric polymers. Inter alia, for example, polyvinyl alcohol, gelatin, and a cellulose derivative are preferable.

In addition, as the surfactant to be contained in the aqueous phase, an anionic or nonionic surfactant which dose not act with the protective colloid and does not cause precipitation or aggregation can be appropriately used. Examples of the surfactant include sodium alkylbenzenesulfonate, sodium alkylsulfate, sodium salt of dioctyl sulfosuccinate, and polyalkylene glycol (e.g., polyoxyethylene nonyl phenyl ether).

Organic Base

The heat-sensitive recording material of the invention preferably contains an organic base as a basic substance for the purpose of promoting a coupling reaction between the diazonium salt and the coupler.

Examples of the organic salt include nitrogen-containing compounds such as tertiary amines, piperidines, piperazines, amidines, formamidines, pyridines, guanidines, and morpholines. Those described in Japanese Patent Application Publication (JP-B) No. 52-46806, JP-A Nos. 62-70082, 57-169745, 60-94381, and 57-123086, 60-49991, JP-B Nos. 2-24916, and 2-28479, and JP-A Nos. 60-165288, and 57-185430 can be preferably used as such. These may be used alone, or two or more of these may be used together.

Among the aforementioned bases, specifically, piperazines such as N,N'-bis(3-phenoxy-2-hydroxypropyl) piperazine, N,N'-bis[3-(p-methylphenoxy)-2-hydroxypropyl]piperazine, N,N'-bis[3-(p-methoxyphenoxy)-2-hydroxypropyl]piperazine, N,N'-bis(3-phenylthio-2-hydroxypropyl)piperazine, N,N'-bis[3-(β-naphthoxy)-2-hydroxypropyl]piperazine, N-3-(β-naphthoxy)-2-hydroxypropyl-N'-methylpiperazine, and 1,4-bis{[3-(N-methylpiperazino)-2-hydroxy] propyloxy}benzene, morpholines such as N-[3-(β-naphthoxy)-2-hydroxy]propylmorpholine, 1,4-bis(3-morpholino-2-hydroxy-propyloxy)benzene, and 1,8-bis(3-morpholino-2-hydroxy-propyloxy)benzene, piperidines such as N-(3-phenoxy-2-hydroxypropyl)piperidine, and N-dodecylpiperidine, and guanidines such as triphenylguanidine, tricyclohexylguanidine, and dicyclohexylphenylguanidine are preferable.

It is preferable that the amount of the organic base to be used is 0.1 to 30 parts by mass relative to 1 part by mass of the diazonium salt.

When the amount is smaller than 0.1 parts by mass, sufficient color density can not be obtained in some cases. When the amount exceeds 30 parts by mass, decomposition of the diazonium salt is promoted in some cases.

Other Components

In addition to the aforementioned organic base, the heat-sensitive recording layer in the invention may contain a color developing auxiliary for the purpose of promoting a color developing reaction, that is, thermally printing images rapidly and completely at a low energy. Here, the color developing auxiliary is a substance which enhances a color developing density at the time of thermal recording, or controls a developing temperature, and the auxiliary adjusts conditions under which the diazonium salt, the basic substance, the coupler and the like are easily reacted by an action of lowering the melting point of the coupler, the basic substance or the diazonium salt or the like, or lowering the softening point of the capsule wall.

Examples of the color developing auxiliary include a phenol derivative, a naphthol derivative, alkoxy-substituted benzenes, alkoxy-substituted naphthalenes, an aromatic ether, a thioether, an ester, an amide, an ureide, an urethane, a sulfonamide compound, and a hydroxy compound.

The color developing auxiliary includes a thermally fusible substance. The thermally fusible substance is a substance having a melting point of 50 to 150° C. which is solid at a normal temperature, which melts when heated, and which can dissolve the diazonium salt, the coupler, and the organic base. Specific examples thereof include a carboxylic acid amide, an N-substituted carboxylic acid amide, a ketone compound, an urea compound, and esters.

The heat-sensitive recording material of the invention preferably contains the following known antioxidant and the like for the purpose of improving fastness of a developed image to light and heat, or for the purpose of decreasing yellowing of an unprinted portion (non-image portion) due to light after fixation.

The antioxidant is described, for example, in EP Nos. 223,739, 309,401, 309,402, 310,551, 310,552, and 459,416, German Patent Laid-Open No. 3,435,443, JP-A Nos. 54-48535, 62-262047, 63-113536, 63-163351, 2-262654, 2-71262, 3-121449, 5-61166, and 5-119449, and U.S. Pat. Nos. 4,814,262, and 4,980,275.

It is also effective to use known additives which are already used in the heat-sensitive or pressure-sensitive recording materials.

Examples of the additives include compounds described, for example, in JP-A Nos. 60-107384, 60-107383, 60-125470, 60-125471, 60-125472, 60-287485, 60-287486, 60-287487, 60-287488, 61-160287, 61-185483, 61-211079, 62-146678, 62-146680, 62-146679, 62-282885, 63-051174, 63-89877, 63-88380, 63-088381, 63-203372, 63-224989, 63-251282, 63-267594, 63-182484, 1-239282, 4-291685, 4-291684, 5-188687, 5-188686, 5-110490, and 5-170361, and JP-B Nos. 48-043294 and 48-033212.

Specific examples thereof include 6-ethoxy-1-phenyl-2,2,4-trimethyl-1,2-dihydroquinoline, 6-ethoxy-1-octyl-2,2,4-trimethyl-1,2-dihydroquinoline, 6-ethoxy-1-phenyl-2,2,4-trimethyl-1,2,3,4-tetrahydroquinoline, 6-ethoxy-1-octyl-2,2,4-trimethyl-1,2,3,4-tetrahydroquinoline, nickel cyclohexanoate, 2,2-bis(4-hydroxyphenyl)propane, 1,1-bis(4-hydroxyphenyl)-2-ethylhexane, 2-methyl-4-methoxydiphenylamine, and 1-methyl-2-phenylindole.

The amount of the antioxidant or various additives to be added is preferably 0.05 to 100 parts by mass, and more preferably 0.2 to 30 parts by mass relative to 1 part by mass of the diazonium salt.

The antioxidant and various additives may be contained in the microcapsules together with the diazonium salt, or may be contained as a solid dispersion together with the coupler, the basic substance and other color developing auxiliary, or may be contained in an emulsion together with a suitable emulsifying auxiliary, or may be contained in those both forms. In addition, the antioxidant and various additives may be used alone, or a plurality of these compounds may be used together. Furthermore, they may be contained in a protective layer.

It is not necessary that the antioxidant and various additives are contained in the same layer.

When a plurality of the antioxidants and/or a plurality of various additives are used together, they are structurally classified into anilines, alkoxybenzenes, hindered phenols, hindered amines, hydroquinone derivatives, phosphorus compounds and sulfur compounds, and compounds which are classified into different structural groups may be combined or compounds which are classified into the same structural group may be combined.

In order to decrease yellowing at a background portion after image recording, the heat-sensitive recording material of the invention may contain a free radical generating agent (compound which generates a radical by irradiation with light) which is used in a photopolymerizable composition.

Examples of the free radical generating agent include aromatic ketones, quinones, benzoin, benzoin ethers, azo compounds, organic disulfides, and acyloximeesters.

It is preferable that the amount of the free radical generating agent to be added is 0.01 to 5 parts by mass relative to 1 part by mass of the diazonium salt.

Similarly, in order to decrease yellowing, a polymerizable compound having an ethylenic unsaturated bond (hereinafter, referred to as "vinyl monomer") may be used. The vinyl monomer is a compound having at least one ethylenic unsaturated bond (vinyl group, vinylidene group or the like) in a chemical structure thereof and having a chemical form of a monomer or a prepolymer.

Examples of the vinyl monomer include unsaturated carboxylic acids and salts thereof, esters of an unsaturated carboxylic acid and an aliphatic polyhydric alcohol, and amides of an unsaturated carboxylic acid and aliphatic polyvalent amine compound. The vinyl monomer is used in an amount of 0.2 to 20 parts by mass relative to 1 part by mass of the diazonium salt.

The free radical generating agent, vinyl monomer and the diazonium salt may be contained in the microcapsules.

Furthermore, the heat-sensitive recording material of the invention may contain, as an acid stabilizer, citric acid, tartaric acid, oxalic acid, boric acid, phosphoric acid, and/or pyrophosphoric acid.

The heat-sensitive recording layer may be provided by preparing a coating solution for forming the heat-sensitive recording layer containing the oxonol dye, the microcapsules containing the diazonium salt, the coupler and, if necessary, an organic base and other additive, and coating the coating solution on a support, followed by drying.

The method of coating the coating solution can be appropriately selected from known ones, and examples thereof include bar coating, blade coating, air knife coating, gravure coating, roll coating, spray coating, dip coating, and curtain coating. It is preferable that the dry application amount of the heat-sensitive recording layer is 2.5 to 30 g/m$^2$.

The structure of the heat-sensitive recording layer in the heat-sensitive recording material of the invention is not particularly limited. For example, the heat-sensitive recording layer may be a single layer which contains all of the microcapsules, the coupler, and the organic base, or a plurality of layers in which they are contained in separate layers. Moreover, an intermediate layer described in JP-A No. 61-54980 can be provided between the support and the heat-sensitive recording layer.

Furthermore, the heat-sensitive recording material of the invention can be a full color developing type one having a plurality of heat-sensitive recording layers which have different hues.

In the heat-sensitive recording material of the invention, each of the heat-sensitive recording layer, the intermediate layer and the protective layer described later may contain a binder, and the binder can be appropriately selected from known water-soluble polymer compounds and latices.

Examples of the water-soluble polymer compound include methyl cellulose, carboxymethyl cellulose, hydroxyethey cellulose, hydroxypropyl cellulose, a starch derivative, casein, gum arabic, gelatin, an ethylene-maleic anhydride copolymer, a styrene-maleic anhydride copolymer, polyvinyl alcohol, silanol-modified polyvinyl alcohol, carboxy-modified polyvinyl alcohol, an epichlorohydrin-modified polyamide, an isobutylene-maleic anhydride copolymer, a polyacrylic acid, a polyacrylic acid amide and modified products thereof.

Examples of the latices include a styrene-butadiene rubber latex, a methyl acrylate-butadiene rubber latex, and a vinyl acetate emulsion.

Inter alia, hydroxyethyl cellulose, a starch derivative, gelatin, a polyvinyl alcohol derivative, and a polyacrylic acid amide derivative are preferable.

In addition, the heat-sensitive recording material of the invention may contain a pigment, and examples of the pigment include known pigments which can be organic or inorganic, such as kaolin, calcined kaolin, talc, agalmatolite, diatomaceous earth, calcium carbonate, aluminium hydroxide, magnesium hydroxide, zinc oxide, lithopone, amorphous silica, colloidal silica, calcined gypsum, silica, magnesium carbonate, titanium oxide, alumina, barium carbonate, barium sulfate, mica, microbaloon, urea-formalin filler, polyester particles, and cellulose filler.

In addition, if necessary, various additives such as a known wax, an antistatic agent, a defoaming agent, an electrically conducting agent, a fluorescent dye, a surfactant, an ultraviolet-ray absorbeing agent and a precursor thereof may be used.

<Other Layers>

At least one protective layer may be provided on the heat-sensitive recording layer.

Examples of a material used in the protective layer include water-soluble polymer compounds such as polyvinyl alcohol, carboxy-modified polyvinyl alcohol, a vinyl acetate-acrylamide copolymer, silicon-modified polyvinyl alcohol, starch, modified starch, methyl cellulose, carboxymethyl cellulose, hydroxymethyl cellulose, gelatins, gum arabic, casein, a styrene-maleic acid copolymer hydrolysate, a styrene-maleic acid copolymer half ester hydrolysate, an isobutylene-maleic anhydride copolymer hydrolysate, a polyacrylamide derivative, a polyvinylpyrrolidone, a sodium polystyrenesulfonate, and sodium alginate, and latices such a styrene-butadiene rubber latex, an acrylonitrile-butadiene rubber latex, a methyl aclylate-butadiene rubber latex, and a vinyl acetate emulsion.

The storage stability of the water-soluble polymer compound may be improved by cross-linking. A cross-linking agent may be appropriately selected from known cross-linking agents, and examples thereof include water-soluble initial condensates such as N-methylolurea, N-methylolmelamine, and urea-formalin; dialdehyde compound such as glyoxal, and glutaraldehyde; inorganic cross-linking agents such as boric acid, and borax; and polyamideepichlorohydrin.

A known pigment, a metal soap, a wax, a surfactant and the like may be further used in the protective layer. In addition, a known ultraviolet-ray absorbing agent or a precursor thereof may be contained in the protective layer.

The protective layer can be formed by coating a coating solution for forming a protective layer, and the dry coating amount of the protective layer is preferably 0.2 to 5 g/m$^2$, and more preferably 0.5 to 2 g/m$^2$. The thickness of the protective layer is preferably 0.2 to 5 $\mu$m, and more preferably 0.5 to 2 $\mu$m.

The protective layer can be provided by the aforementioned known coating methods as in formation of the heat-sensitive recording layer on a support.

When the heat-sensitive recording material of the invention is a multicolor heat-sensitive recording material having photofixing-type heat-sensitive recording layers on a support, an intermediate layer may be provided between the respective heat-sensitive recording layers for the purpose of preventing color mixing of the heat-sensitive recording layers.

The intermediate layer is made of a water-soluble polymer compound such as gelatin, phthalated gelatin, polyvinyl alcohol, or polyvinylpyrrolidone, and may appropriately contain various additives.

In the case of a multicolor heat-sensitive recording material, a light transmittance adjusting layer or a protective layer, or a light transmittance adjusting layer and a protective layer are provided as an upper layer thereof, if necessary. The light transmittance adjusting layer is described in JP-A Nos. 9-39395, 9-39396, and Japanese Patent Application No. 7-208386.

When a component which functions as an ultraviolet-ray absorbing agent precursor is used in the light transmittance adjusting layer, light having a wavelength in the region necessary for fixation can sufficiently pass the light transmittance adjusting layer during fixation of the photofixing-type heat-sensitive recording layer, and visible light transmittance of the light transmittance adjusting layer is also high, and, thus, fixation of the heat-sensitive recording layer is not adversely affected by the component. This is because the component does not function as an ultraviolet-ray absorbing agent before light having a wavelength in the region necessary for fixation is irradiated, and has a high light transmittance.

Meanwhile, after light in the wavelength region necessary for photofixation (photodegradation of a diazonium salt due to light irradiation) of the photofixing-type heat-sensitive recording layer is irradiated, the ultraviolet-ray absorbing agent precursor reacts due to the light, and comes to function as the ultraviolet-absorbing agent. The resultant ultraviolet-ray absorbing agent absorbs a majority of light having a wavelength in the ultraviolet-ray region, and the ultraviolet-ray transmittance of the light transmittance adjusting layer lowers, improving light resistance of the heat-sensitive recording material. However, the ultraviolet-ray absorbing agent does not absorb visible light, and visible light transmittance of the light transmittance adjusting layer does not substantially change.

At least one light transmittance adjusting layer can be provided in the heat-sensitive recording material. In particular, the layer is preferably provided between the heat-sensitive recording layer and the protective layer. Alternatively, a protective layer which can also serve as the light transmittance adjusting layer may be used.

<Support>

As a support usable in the heat-sensitive recording material of the invention, any paper supports used in ordinary pressure-sensitive material and heat-sensitive material, and dry or wet diazo copying material can be used. Additionally, acidic paper, neutral paper, coated paper, plastic film-laminated paper, synthetic paper, and plastic films such as polyethylene terephthalate and polyethylene naphthalate can be used.

A back coated layer may be provided on a support for the purpose of correcting curl balance, or for the purpose of improving chemical resistance of the back surface of the support. The back coated layer can be provided in the same manner as the protective layer.

Furthermore, if necessary, an anti-halation layer may be provided between the support and the heat-sensitive recording layer, or on the support surface having provided thereon the heat-sensitive recording layer. Moreover, a sliding layer, an antistatic layer, and/or an adhesive layer may be provided on another support surface.

In addition, the heat-sensitive recording material can be used as a label by providing an adhesive layer on the back surface of the support (the surface on which no heat-sensitive recording layer is provided) and adhering peeling paper to the adhesive layer.

Image Forming Method

Image formation using the heat-sensitive recording material of the invention may be performed, for example, by a method in which the surface of a support having provided thereon a heat-sensitive recording layer is imagewise heated with a heating unit such as a thermal head, and in which a capsule wall containing a polyurea and/or a polyurethane and encapsulating a diazonium salt in heated portions of the heat-sensitive recording layer is softened and allows a coupler and a basic substance (organic base) outside the capsules to enter the microcapsules, and in which the diazonium salt and the coupler imagewise forms a color to form an image. In this case, further irradiation of light having the same wavelength as an absorption wavelength of the diazonium salt (photofixation) after color development causes decomposition reaction of the diazonium salt and then the diazonium salt loses reactivity with the coupler, and fixation of the image can be conducted. Conducting photofixation as described above causes an unreacted diazonium salt to decompose and to lose activity thereof, which can suppress variation in density of the formed image, coloring due to generation of stains at a non-image portion (background portion), that is, deterioration in whiteness, and reduction in image contrast accompanied with that deterioration.

Examples of a light source used in the photofixation include various fluorescent lamps, xenon limps, and mercury lumps. It is preferable that a light-emitting spectrum of the light source approximately corresponds to the absorption spectrum of the diazonium salt in the heat-sensitive recording material from the viewpoint of efficient fixation.

In the invention, it is particularly preferable to use a light source which emits light having a light-emitting central wavelength of 350 to 430 nm.

In addition, the heat-sensitive recording material of the invention may be used as a photowriting thermal-developing type heat-sensitive recording material, on which light is imagewise irradiated to write and thermally develop an image. In this case, a light source such as a laser is used for writing in place of the aforementioned heating apparatus.

The heat-sensitive recording material of the invention can be a multicolor heat-sensitive recording material by laminating a plurality of heat-sensitive recording layers which develop different hues. Examples of the heat-sensitive recording layer to be laminated include a heat-sensitive recording layer containing a photodegradable diazonium salt.

The aforementioned multicolor heat-sensitive recording material is described in JP-A Nos. 3-288688, 4-135787, 4-144784, 4-144785, 4-194842, 4-247447, 4-247448, 4-340540, 4-340541, 5-34860, 5-194842, and 9-156229.

The multicolor heat-sensitive recording material may have, for example, the following layer configuration, which does not limit the invention.

That is, the material may have a configuration in which a first heat-sensitive recording layer containing an electron-donating dye precursor and an electron-accepting compound, or containing at least two kinds of diazonium salts having a maximum absorption wavelength shorter than 350 nm and a coupler which reacts with these diazonium salts when heated to develop a color (A layer), a second heat-sensitive recording layer containing at least two kinds of diazonium salts which develop a color having a hue different from that of A layer and have a maximum absorption wavelength of 360 nm±20 nm and a coupler which reacts with these diazonium salts when heated to develop the color (B layer), and a third heat-sensitive recording layer containing at least two kinds of diazonium salts which develop a color having a hue different from that of A layer and that of B layer and have a maximum absorption wavelength of 400±20 nm and a coupler which reacts with these diazonium dalts when heated to develop the color (C layer).

The electron-donating colorless dye and the electron-accepting compound used herein are not particularly limited, and are described in detail in JP-A Nos. 6-328860, 7-290826, 7-314904, 8-324116, 3-37727, 9-31345, 9-111136, 9-118073, and 11-157221. Examples of the electron-accepting compound include phenol derivatives, salicylic acid derivatives, and hydroxylbenzoic acid esters. In particular bisphenols, and hydroxybenzoic acid esters are preferable. Examples thereof include 2,2-bis(p-hydroxyphenyl)propane (that is, bisphenol A), 4,4'-(p-phenylenediisopropylidene)diphenol (that is, bisphenol P), 2,2-bis(p-hydroxyphenyl)pentane, 2,2-bis(p-hydroxyphenyl)ethane, 2,2-bis(p-hydroxyphenyl)butane, 2,2-bis(4'-hyroxy-3',5'-dichlorophenyl)propane, 1,1-(p-hydroxyphenyl)cyclohexane, 1,1-(p-hydroxyphenyl)propane, 1,1-(p-hydroxyphenyl)pentane, 1,1-(p-hydroxyphenyl)-2-ethylhexane, 3,5-di(α-methylbenzyl)salicylic acid and polyvalent metal salts thereof, 3,5-di(tert-butyl)salicylic acid and polyvalent metal salts thereof, 3-α,α-dimethylbenzylsalicylic acid and polyvalent metal salts thereof, butyl p-hydroxybenzoate, benzyl p-hydroxybenzoate, 2-ethylhexyl p-hydroxybenzoate, p-phenylphenol and p-cumylphenol.

When the material has the aforementioned A, B and C layers, it is possible to record full color images by making developed hues of respective heat-sensitive recording layers three primary colors in substructive color process: yellow, magenta and cyan. In the layer configuration of a full color recording material, yellow, magenta and cyan color-developing layers may be laminated in any manner. However, from the viewpoint of color reproductivity, it is preferable to laminate an yellow color developing layer, a cyan color-developing layer and a magenta color-developing layer, or an yellow color-developing layer, a magenta color-developing layer and a cyan color-developing layer in this order from a support side.

Image formation using a multicolor heat-sensitive recording material can be performed, for example, as follows:

First, a third heat-sensitive recording layer (C-layer) is heated to cause a diazonium salt and a coupler contained therein to react with each other to develop a color. Then, light having an wavelength of 400±20 nm is irradiated on the recording material to decompose an unreacted diazonium salt contained in C layer. Then, a second heat-sensitive recording layer (B layer) is sufficiently heated to cause a diazonium salt and a coupler contained therein to react with each other to develop a color. At this time, C layer is also heated. However, since the diazonium salt contained in C layer has been decomposed and has lost a developing ability, C layer does not change. Thereafter, light having an wavelength of 360±20 nm is irradiated on the recording layer to decompose the diazonium salt contained in B layer. Finally, a first heat-sensitive recording layer (A layer) is sufficiently heated to develop a color. At this time, C and B layers are also heated. However, since the diazonium salts contained in these layers have been decomposed and has lost a developing ability, these layers do not change.

The developing mechanism of the heat-sensitive recording layer (A layer) which is directly laminated on the support surface is not limited to a combination of an electron-donating dye and an electron-accepting dye, or a combination of a diazonium salt and a coupler which reacts with the diazonium salt when heated to develop a color, and can be any of a base developing system which develop a color when brought into contact with a basic compound, a chelate developing system, a developing system which reacts with a nucleophilic agent to cause a leaving reaction and to develop a color. A multicolor heat-sensitive recording material can be prepared by providing a heat-sensitive recording layer containing a diazonium salt and a coupler which reacts with the diazonium salt to develop a color on this heat-sensitive recording layer.

EXAMPLES

The invention will be explained by way of Examples, however the invention is not limited by these Examples. In Examples, "part" and "%" represent "part by mass" and "% by mass" respectively.

Example 1

<Preparation of Phthalated Gelatin Solution>

32 parts of phthalated gelatin (trade name; #801 gelatin, manufactured by Nitta Gelatin Inc.), 0.9143 part of 1,2-benzothiazoline-3-one (3.5% methanol solution, manufactured by Daito Chemical Industries, Ltd.) and 367.1 parts of deionized water were mixed, and dissolved at 40° C. to obtain an aqueous phthalated gelatin solution.

<Preparation of Alkali-treated Gelatin Solution>

25.5 parts of alkali-treated gelatin having a low ion content (trade name; #750 gelatin, manufactured by Nitta Gelatin Inc.), 0.7286 part of 1,2-benzothiazoline-3-one (3.5% methanol solution, manufactured by Daito Chemical Industries, Ltd.), 0.153 part of calcium hydroxide and 143.6 parts of deionized water were mixed, and dissolved at 50° C. to obtain an aqueous gelatin solution for making an emulsion.

(1) Preparation of Yellow Color-eveloping Heat-sensitive Recording Layer Solution <Preparation of Diazonium Salt Compound-encapsulated Microcapsule Solution (a)>

2.2 parts of the following diazonium compound (A) (maximum absorption wavelength: 420 nm), 2.2 parts of the following diazonium compound (B) (maximum absorption wavelength: 420 nm), 4.8 parts of monoisopropylbiphenyl, 4.8 parts of diphenyl phthalate and 0.5 part of diphenyl-(2,4,6-trimethylbenzoyl)phosphine oxide (trade name: Lucirin TP0, manufactured by BASF Japan) were added to 16.1 parts of ethyl acetate, and the materials were heated to 40° C. and dissolved uniformly. 8.6 parts of a mixture of xylilene diisocyanate/trimethtylolpropane adduct and xylilene diisocyanate/bisphenol A adduct (trade name; Takenate D119N (50% by weight of ethyl acetate solution), manufactured by Takeda Chemical Industries, Ltd.) was added as a capsule wall material to the resultant mixture, and these materials were uniformly stirred to obtain a mixture (I).

Separately, 16.3 parts of deionized water and 0.34 part of Scraph AG-8 (50% by weight) (manufactured by Nippon Fine Chemical Co., Ltd.) were added to 58.6 parts of the aforementioned aqueous phthalated gelatin solution to obtain a mixture (II).

The mixture (I) was added to the mixture (II), and the resultant mixture was emulsification-dispersed at 40° C. with a homogenizer (manufactured by Nippon Seiki Seisakusho). After 20 parts of water was added to the resulting emulsion and the resultant was made uniform, the resultant emulsion was heated at 40° C. to conduct a capsulation reaction for 3 hours while stirred to remove ethyl acetate. Thereafter, 4.1 parts of a deionized resin Amberlite IRA68 (manufactured by Organo Corporation) and 8.2 parts of a deionized resin Amberlite IRC50 (manufactured by Organo Corporation) were added to the reaction system, followed by further stirring for 1 hour. Then, the deionized resins were removed by filtration, and the concentration of the system (capsule solution) was adjusted so that the solid content concentration of the capsule solution became 20.0%, to obtain a diazonium salt compound-encapsulated microcapsule solution (a). The median diameter of the resulting microcapsules was measured by a measuring device (LA-700, manufactured by Horiba, Ltd.) and, as a result, it was found that the median diameter was 0.36 $\mu$m.

Diazonium Salt Compound A

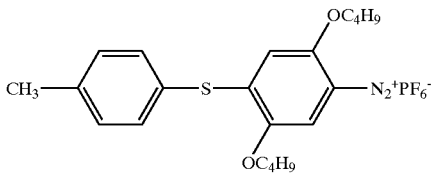

Diazonium Salt Compound B

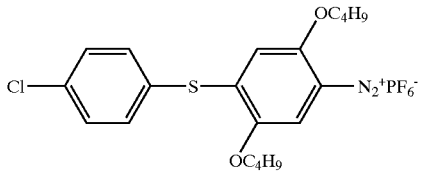

<Preparation of Coupler Compound Emulsion (a)>

9.9 parts of the following coupler compound (C), 9.9 parts of triphenylguanidine (manufactured by Hodogaya Chemical Co., Ltd.), 20.8 parts of 4,4'-(m-phenylenediisopropylidene)diphenol (trade name; Bisphenol M, manufactured by Mitsui Petrochemical Industries, Ltd.), 3.3 parts of 3,3,3',3'-tetramethyl-5,5',6,6'-tetra(1-propoxy)-1,1'-spirobisindane, 13.6 parts of 4-(2-ethylhexyloxy)benzenesulfonic acid amide (manufactured by Manac Incorporated), 6.8 parts of 4-n-pentyloxybenzenesulfonic acid amide (manufactured by Manac Incorporated) and 4.2 parts of calcium dodecylbenzenesulfonate (trade name; Pionin A-41-C, 70% methanol solution, manufactured by Takemoto Oil & Fat Co., Ltd.) were dissolved in 33.0 parts of ethyl acetate to obtain a mixture (III).

Separately, 107.3 parts of deionized water was mixed with 206.3 parts of the aforementioned aqueous solution of alkali-treated gelatin to obtain a mixture (IV).

The mixture (III) was added to the mixture (IV), and the resultant was emulsification-dispersed at 40° C. with the homogenizer (manufactured by Nihon Seiki Seisakusho). The resulting coupler compound emulsion was heated under reduced pressure to remove ethyl acetate, and concentration adjustment was performed so that the solid content concentration of the resultant became 26.5% by weight. The median diameter of particles contained in the resulting coupler compound emulsion was measured with the measuring device (LA-700, manufactured by Horiba, Ltd.) and, as a result, it was found that the median diameter was 0.21 $\mu$m.

9 parts of a latex in which SBR latex (trade name; SN-307, 48% solution, manufactured by Sumika ABS Latex) was adjusted to have an adjusted concentration of 26.5% was added to 100 parts of the aforementioned coupler compound emulsion, and the resultant was uniformly stirred to obtain a coupler compound emulsion (a).

Coupler Compound C

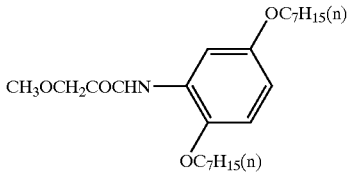

<Preparation of Coating Solution (a)>

The aforementioned diazonium salt compound-encapsulated microcapsule solution (a) and the aforementioned coupler compound emulsion (a) were mixed so that the weight ratio of the encapsulated coupler compound to the diazo compound became 2.2:1, whereby, a heat-sensitive recording layer coating solution (a) was obtained.

(2) Preparation of Magenta Color-developing Heat-sensitive Recording Layer Solution <Preparation of Diazonium Salt Compound-encapsulated Microcapsule Solution (b)>

3.8 parts of the following diazonium salt compound (2-1), 7.6 parts of isopropylbiphenyl, 2.0 parts of tricresyl phosphate, 1.1 parts of dibutyl sulfate, 0.40 parts of ethyl 2,4,6-trimethylbenzoylphenylphosphinate (trade name; Lucirin TP0-L, manufactured by BASF) and 0.07 part of calcium dodecylbenzenesulfonate (trade name; Pionin A-41-C, 70% methanol solution, manufactured by Takemoto Oil & Fat Co., Ltd.) were added to 12.8 parts of ethyl acetate, and the materials were heated and dissolved uniformly. 10.9 parts of xylene diisocyanate/trimethylolpropane adduct (trade name; Takenate D110N (75% by weight ethyl acetate solution), manufactured by Takeda Chemical Industries, Ltd.) was added as a capsule wall material to the above mixture, and the resultant was uniformly stirred to obtain a mixture (V).

Separately, 22.8 parts of deionized water and 0.31 part of 25% aqueous sodium dodecylbenzenesulfonate solution (trade name; Neopelex F-25, manufactured by Kao Corporation) were added to and mixed with 59.9 parts of the aforementioned aqueous phthalated gelatin solution, to obtain a mixture (VI).

The mixture (V) was added to the mixture (VI), and the resultant was emulsification-dispersed at 30° C. with the homogenizer (manufactured by Nihon Seiki Seisakusho). 29.1 parts of water was added to the resulting emulsion and the resultant was made uniform. Then, the resultant was heated at 40° C. to conduct a capsulation reaction for 3 hours while stirred to remove ethyl acetate. Thereafter, 0.28 part of 1,2-benzothiazoline-3-one (3.5% methanol solution, manufactured by Daito Chemical Industries, Ltd.) was added to the reaction system.

Then, 5.0% of deionized resin Amberlite IRA67 (manufactured by Organo Corporation) and 10.0 parts of SWA100-HG (manufactured by Organo Corporation) were added to the system, and the resultant was stirred for 40 minutes. Thereafter, the deionized resin was removed by filtration, and the concentration of the system (capsule solution) was adjusted so that the solid content concentration of the capsule solution became 18.5%, whereby, a diazonium salt compound-encapsulated microcapsule solution (a) was obtained. The median diameter of the resulting microcapsules was measured with the measuring device (LA-700, manufactured by Horiba, Ltd.) and, as a result, it was found that the median diameter was 0.62 μm.

<Preparation of Coupler Compound Emulsion (b)>

7.0 Parts of the following coupler compound (E), 14.0 parts of triphenylguanidine (manufactured by Hodogaya Chemical Co., Ltd.), 14.0 parts of 4,4'-(m-phenylenediisopropylidene)diphenol (trade name; Bisphenol M, manufactured by Mitsui Petrochemical Industries, Ltd.), 14 parts of 1,1-(p-hydroxypheyl)-2-ethylhexane, 3.5 parts of 3,3,3',3',-tetramethyl-5,5',6,6'-tetra(1-propoxy)-1,1'-spirobisindane, 3.5 parts of the following compound (G), 1.7 parts of tricresyl phosphate, 0.8 part of diethyl maleate and 4.5 parts of calcium dodecylbenzenesulfonate (trade name; Pionin A-41-C, 70% methanol solution, manufactured by Takemoto Oil & Fat Co., Ltd.) were dissolved in 36.9 parts of ethyl acetate to obtain a mixture (VII).

Separately, 107.3 parts of deionized water was mixed with 206.3 parts of the aforementioned aqueous solution of alkali-treated gelatin to obtain a mixture (VIII).

The mixture (VII) was added to the mixture (VIII), and the resultant was emulsification-dispersed at 40° C. with the homogenizer (manufactured by Nihon Seiki Seisakusho). The resulting coupler compound emulsion was heated under reduced pressure to remove ethyl acetate, and the concentration of the emulsion was adjusted so that the solid content concentration thereof became 25.4% by weight, whereby, a coupler compound emulsion (b) was obtained. The median diameter of particles contained in the resulting coupler compound emulsion was measured with the measuring device (LA-700, manufactured by Horiba, Ltd.) and, as a result, it was found that the median diameter was 0.22 μm.

Coupler Compound E

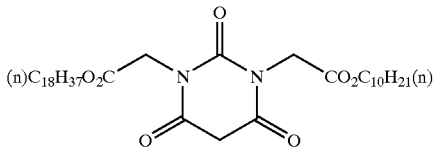

Compound (G)

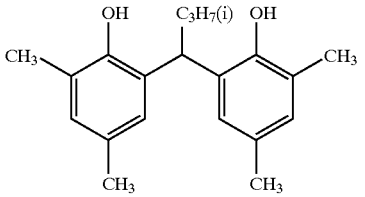

<Preparation of Coating Solution (b)>

The aforementioned diazonium salt compound-encapsulated microcapsule solution (a) and the aforementioned coupler compound emulsion (b) were mixed so that the weight ratio of encapsulated coupler compound/diazo compound became 1.9/1. Furthermore, 0.2 part of an aqueous polystyrenesulfonic acid (a part of the polystyrenesulfonic acid is neutralized with potassium hydroxide) solution (5% by weight) and 0.12 part of 0.1 wt % aqueous oxanol dye compound (1-1) solution were mixed with 10 parts of the capsule solution, whereby, a heat-sensitive recording layer coating solution (b) was obtained.

(3) Preparation of Cyan Color-developing Heat-sensitive Recording Layer Solution <Preparation of Electron-donating Dye Precursor-encapsulated Microcapsule Solution (c)>

8.0 parts of the following electron-donating dye (H), 8.0 parts of a mixture of 1-methylpropylphenyl-pheylmethane and 1-(1-methylpropylphenyl)-2-phenylethane (trade name; Hisol SAS-310, manufactured by Nippon Oil Corporation) and 8.0 parts of the following compound (I) (trade name; Irgaperm2140, Ciba-Geigy Corp.) were added to 18.1 parts of ethyl acetate, and the materials were heated and dissolved uniformly. 7.2 parts of xylene diisocyanate/trimethylolpropane adduct (trade name; Takenate D110N (75 wt % ethyl acetate solution), manufactured by Takeda Chemical Industries, Ltd.) and 5.3 parts of polymethylene-polyphenyl polyisocyanate (trade name; Millionate MR-200, manufactured by Nippon Polyurethane Industries Co., Ltd.) as capsule wall materials were added to the above mixture, and the resultant was uniformly stirred to obtain a mixture (IX).

Separately, 9.5 parts of deionized water, 0.17 part of Scraph AG-8 (50% by weight) (manufactured by Nihon Fine Chemical Co., Ltd.) and 4.3 parts of sodium dodecylbenzenesulfonate (10% aqueous solution) were added to and mixed with 28.8 parts of the aforementioned aqueous phthalated gelatin solution, to obtain a mixture (X).

The mixture (IX) was added to the mixture (X), and the resultant was emulsification-dispersed at 40° C. with the homogenizer (Nihon Seiki Seisakusho). 50 Parts of water and 0.12 part of tetraethylenepentamine were added to the resulting emulsion and the resultant was made uniform. The resultant was heated at 65° C. to conduct a capsulation reaction for 3 hours while stirred to remove ethyl acetate. Then, the concentration of the reaction system (capsule solution) was adjusted so that the solid content concentration of the capsule solution became 33%, whereby, a microcapsule solution was obtained. The median diameter of the resulting microcapsules was measured with the measuring device (LA-700, manufactured by Horiba, Ltd.) and, as a result, it was found that the median diameter was 1.00 μm. Furthermore, 3.7 parts of a 25% aqueous sodium dodecylbenzenesulfonate solution (trade name; Neopelex F-25, manufactured by Kao Corporation) and 4.3 parts of a fluorescent brightener containing a 4,4'-bistriazinylaminostilbene-2,2'-disulfone derivative (trade name; Kaycoll BXNL, manufactured by Nippon Soda Co., Ltd.) were added to 100 parts of the aforementioned microcapsule solution, and the resultant was uniformly stirred to obtain a microcapsule dispersion liquid (c).

Electron-donating Dye (H)

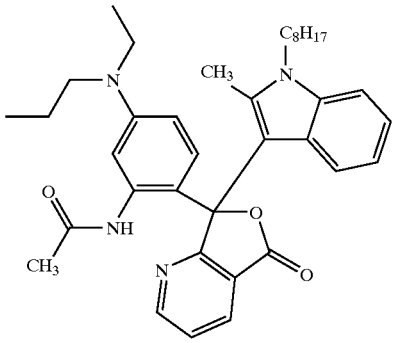

Compound (I)

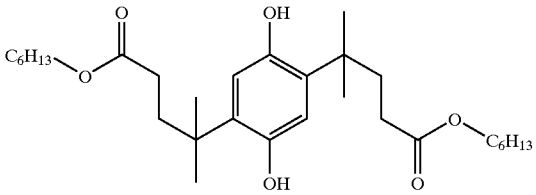

<Preparation of Electron-accepting Compound Dispersion Liquid (c)>

30.1 parts by weight of deionized water, 15 parts by weight of 4,4'-(p-phenylenediisopropylidene)diphenol (trade name; Bisphenol P, manufactured by Mitsui Petrochemical Industries, Ltd.) and 3.8 parts by weight of a 2 wt % aqueous sodium 2-ethylhexylsuccinate solution were added to 11.3 parts by weight of the aforementioned aqueous phthalated gelatin solution, and the materials were dispersed with a ball mill overnight to obtain a dispersion liquid. The solid content concentration of this dispersion liquid was 26.6% by weight.

45.2 parts by weight of the aforementioned aqueous solution of alkali-treated gelatin was added to 100 parts by weight of the aforementioned dispersion liquid. Further, 0.65 part by weight of a 0.1% aqueous Methyl Violet solution was added to the resultant, and the resultant mixture was stirred for 30 minutes. Deionized water was added to the mixture so that the solid content concentration of the resultant dispersion liquid became 23.5%, whereby, an electron-accepting compound dispersion liqiud (c) was obtained.

<Preparation of Coating Solution (c)>

The aforementioned electron-donating dye precursor-encapsulated microcapsule solution (c) and the aforementioned electron-accepting compound dispersion (c) were mixed so that the weight ratio of the electron-accepting compound/an electron-donating dye precursor became 10/1, whereby, a coating solution (c) was obtained.

<Preparation of Intermediate Layer Coating Solution>

100.0 parts of alkali-treated gelatin having a low ion content (trade name; #750 Gelatin, manufactured by Nitta Gelatin Inc.), 2.857 parts of 1,2-benzothiazoline-3-one (3.5% methanol solution, manufactured by Daito Chemical Industries, Ltd.), 0.5 part of calcium hydroxide and 521.643 parts of deionized water were mixed, and dissolved at 45° C. to obtain an aqueous gelatin solution for forming an intermediate layer.

10.0 parts of the aforementioned aqueous gelatin solution for forming an intermediate layer, 0.05 part of sodium (4-nonylphenoxytrioxyethylene)butylsulfonate (manufactured by Sankyo Chemical Industries, Ltd., 2.0 wt % aqueous solution), 1.5 parts of boric acid (4.0 wt % aqueous solution), 0.19 part of an aqueous polystyrenesulfonic acid (a part of the polystyrenesulfonic acid is neutralized with potassium hydroxide) solution (5% by weight), 3.42 parts of a 4 wt % aqueous solution of the following compound (J) (manufactured by Wako Pure Chemical Industries, Ltd.), 1.13 parts of a 4 wt % aqueous solution of the following compound (J') and 0.67 part of deionized water were mixed to obtain an intermediate layer coating solution.

Compound (J)

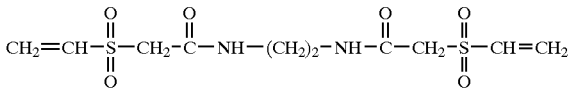

Compound (J')

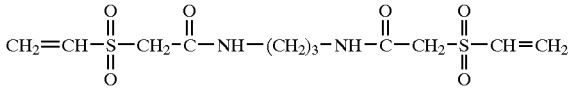

<Preparation of Light Transmittance Adjusting Layer Coating Solution>

(iii-1) Preparation of Ultraviolet-ray Absorbing Agent Precursor Microcapsule Solution 14.5 parts of [2-allyl-6-(2H-benzotriazol-2-yl)-4-t-octylphenyl]benzenesulfonate as an ultraviolet-ray absorbing agent precursor, 5.0 parts of 2,2'-t-octylhydroquinone, 1.9 parts of tricresyl phosphate, 5.7 parts of α-methylstyrene dimer (trade name: MSD-100, manufactured by Mitsui Chemicals, Inc.), and 0.45 part of calcium dodecylbenzenesulfonate (trade name: Pionin A-41-C (70% methanol solution), manufactured by Takemoto Oil & Fat Co., Ltd.) were uniformly dissolved in 71 parts of ethyl acetate. 54.7 parts of xylylene diisocyanate/trimethylolpropane adduct (trade name; Takenate D110N (75 wt % ethyl acetate solution), manufactured by Takeda Chemical Industries, Ltd.) was added to the resultant mixture, and the resultant was stirred to obtain an ultraviolet-ray absorbing agent precursor mixture (VII).

Separately, 8.9 parts of a 30 wt % aqueous phosphoric acid solution and 532.6 parts of deionized water were mixed with 52 parts of itaconic acid-modified polyvinyl alcohol (trade name: KL-318, manufactured by Kuraray Co., Ltd.) to obtain an aqueous PVA solution for an ultraviolet-ray absorbing agent precursor microcapsule solution.

The aforementioned ultraviolet-ray absorbing agent precursor mixture (VII) was added to 516.06 parts of the aforementioned aqueous PVA solution for an ultraviolet-ray absorbing agent precursor microcapsule solution, and the resultant was emulsification-dispersed at 20° C. with the homogenizer (manufactured by Nihon Seiki Seisakusho). 254.1 parts of deionized water was added to the resulting emulsion and the resultant was made uniform. The resultant was heated at 40° C. to conduct a capsulation reaction for 3 hours while stirred. Thereafter, 94.3 parts of a deionized resin Amberlite MB-3 (manufactured by Organo Corporation) was added to the reaction system, and the resultant mixture was stirred for 1 hour. Then, the deionized resin was removed by filtration, and the concentration of the system (capsule solution) was adjusted so that the solid content concentration of the capsule solution became 13.5%. The median diameter of the resulting microcapsules was measured with the measuring device (LA-700, manufactured by Horiba, Ltd.) and, as a result, it was found that the median diameter was 0.23±0.05 μm. 3.0 parts of carboxy-modified styrene-butadiene latex (trade name: SN-307, (48 wt % aqueous solution), manufactured by Sumitomo Naugatuck Co., Ltd.) and 39.5 parts of deionized water were mixed with 859.1 parts of the capsule solution, to obtain an ultraviolet-ray absorbing agent precursor microcapsule solution.

(iii-2) Preparation of Light Transmittance Adjusting Layer Coating Solution 1000 parts of the aforementioned ultraviolet-ray absorbing agent precursor microcapsule solution, 5.2 parts of Megafac F-120 (5 wt % aqueous solution, manufacture by Dainippon Ink and Chemicals, Incorporated), 7.75 parts of a 4 wt % aqueous sodium hydroxide solution and 73.39 parts of sodium (4-nonylphenoxytrioxyethylene)butylsulfonate (manufactured by Sankyo Chemical Industries, Ltd., 2.0 wt % aqueous solution were mixed to obtain a light transmittance adjusting layer coating solution.

<Preparation of Protective Layer Coating Solution>

(iv-1) Preparation of Polyvinyl Alcohol Solution for Protective Layer

160 Parts of vinyl alcohol-alkyl vinyl ethyl copolymer (trade name; EP-130, manufactured by Denki Kagaku Kogyo Kabushiki Kaisha), 8.74 parts of a mixture of sodium alkyl sulfonate and polyoxyethylene alkyl ether phosphoric acid ester (trade name: Neoscore CM-57 (54 wt % aqueous solution), manufactured by Toho Chemical Industry Co., Ltd.) and 3832 parts of deionized water were mixed and dissolved at 90° C. for 1 hour to obtain a uniform polyvinyl alcohol solution for a protective layer.

(iv-2) Preparation of Pigment Dispersion Liquid for Protective Layer 0.25 part of an anionic especial polycarboxylic acid-type polymer surfactant (trade name: Poise 532 A (40 wt % aqueous solution), manufactured by Kao Corporation) and 11.8 parts of deionized water were mixed with 8 parts of barium sulfate (trade name: BF-21 F, barium sulfate content: at least 93%, manufactured by Sakai Chemical Industry Co., Ltd.), and the resultant was dispersed with a Dyno-Mill to obtain a protective layer pigment dispersion liquid. The median diameter of particles contained in the dispersion liquid was measured with a measuring device (LA-910, manufactured by Horiba, Ltd.) and, as a result, it was found that the median diameter was 0.15 μm or smaller.

8.1 parts of colloidal silica (trade name: Snowtex O (20 wt % aqueous dispersion), manufactured by Nissan Chemical Industries, Ltd.) was added to 45.6 parts of the aforementioned barium sulfate dispersion liquid to obtain a desired dispersion.

(iv-3) Preparation of Matting Agent Dispersion Liquid for Protective Layer 3.81 parts of a dispersion in which 1,2-benzisothiazoline-3-one was dispersed in water (trade name: Proxel B.D, manufactured by ICI Americas Inc.) and 1976.19 parts of deionized water were mixed with 220 parts of a wheat starch (trade name: Wheat Starch S, manufactured by Sinshin Shokuryo Kogyo), and the resultant was uniformly dispersed to obtain a matting agent dispersion liquid for the protective layer.

(iv-4) Preparation of Coating Blend Solution for Protective Layer

40 Parts of Megafac F-120 (5 wt % aqueous solution, manufactured by Dainippon Inc and Chemicals, Incorporated), 50 parts of sodium (4-nonylphenoxytrioxyethylene)butylsulfonate (manufactured by Sankyo Chemical Industries, Ltd., 2.0 wt % aqueous solution), 49.87 parts of the aforementioned pigment dispersion liquid for the protective layer, 16.65 parts of the aforementioned matting agent dispersion liquid for the protective layer, 48.7 parts of a zinc stearate dispersion liquid (trade name: Hydrin F115, 20.5 wt % aqueous solution, manufactured by Chukyo Oil & Fat Co., Ltd.) and 280 parts of deionized water were uniformly mixed with 1000 parts of the aforementioned polyvinyl alcohol solution for the protective layer to obtain a coating blend solution for the protective layer.

Support with Undercoat Layer

<Preparation of Undercoat Layer Solution>

40 Parts of gelatin which can decompose with enzyme (average molecular weight: 10,000, viscosity by PAGI method: 15 mP, jelly strength by PAGI method: 20 g) was added to 60 parts of deionized water, and the resultant was stirred and dissolved at 40° C. to prepare an aqueous undercoat layer gelatin solution.

Separately, 8 parts of synthetic mica which swells with water (aspect ratio: 1,000, trade name: Somacif ME100, manufactured by Co-op Chemical Co., Ltd.) and 92 parts of water were mixed, and wet-dispersed with a viscomill to obtain a mica dispersion liquid having an average particle diameter of 2.0 μm. Water was added to and uniformly mixed with the mica dispersion liquid so that the mica concentration became 5% by weight to prepare a desired mica dispersion liquid.

120 Parts of water and 556 parts of methanol were added to 100 parts of the aforementioned 40 wt % aqueous gelatin solution kept at 40° C., the resultant was sufficiently stirred and mixed, 208 parts of the aforementioned 5 wt % mica dispersion liquid was added to the resultant, the resultant mixture was sufficiently stirred and mixed, and 9.8 parts of a 1.66 wt % polyethylene oxide surfactant was added to the resultant. The resultant was kept at 35° C. to 40° C., 7.3 parts of a film hardener of an epoxy compound for gelatin was added to the resultant to prepare an undercoat layer coating solution (5.7% by weight).

<Preparation of Support with Undercoat Layer>

A timber pulp composed of 50 parts of LBPS and 50 parts of LBPX was beated with a disc refiner so that Canadian freeness of the timber pulp became 300 cc, 0.5 part of epoxylated behenic acid amide, 1.0 part of anion polyacrylamide, 1.0 part of aluminium sulfate, 0.1 part of polyamide polyamine epichlorohydrin, and 0.5 part of cation polyacrylamide were added to the timber pulp (all of the above amounts are absolute dry weight ratio relative to pulp). A base paper having a basis weight of 114 g/m$^2$ was made of the above matter with a fourdrinier machine, and the base paper was subjected to calendar treatment to adjust a thickness thereof at 100 $\mu$m.

Then, both surfaces of the base paper were subjected to corona discharge treatment, and polyethylene was extruded on one surface of the base paper with a melting extruder to form a resin layer having a thickness of 36 $\mu$m and a matting surface (this surface is referred to as a back surface). Then, polyethylene containing 10% by weight of anatase type titanium dioxide and a trace of ultramarine was coated on another surface of the base paper which was opposite to the surface on which the resin layer was formed with the melting extruder, to form another resin layer having a thickness of 50 $\mu$m and a glossy surface (this surface is referred to as a front surface). The polyethylene resin-covered surface which was the back surface was subjected to corona discharge treatment, and a dispersion in which a mixture of aluminium oxide (trade name; Alumina Sol 100, manufactured by Nissan Chemical Industries, Ltd.) and silicon dioxide (trade name; Snowtex O, manufactured by Nissan Chemical Industries, Ltd.) at a weight ratio of 1/2 as antistatic agents was dispersed in water, and was applied to the back surface so that a dried weight of the coating was 0.2 g/m$^2$. Then, the polyethylene resin-covered surface which was the front surface was subjected to corona discharge treatment, and the aforementioned undercoating solution was applied to the front surface so that the coating amount of mica was 0.26 g/m$^2$ to obtain a support with an undercoat layer.

<Coating of Each Heat-sensitive Recording Layer Coating Solution>

Seven layers, namely the heat-sensitive recording layer coating solution (c), the intermediate layer coating solution, the heat-sensitive recording layer coating solution (b), the intermediate layer coating solution, the heat-sensitive recording layer coating solution (a), the light transmittance adjusting layer coating solution, and the proective layer coating solution, were successively and simultaneously coated on the undercoat layer in this order, and each layer was dried under conditions of 30° C. and humidity of 30% and 40° C. and humidity of 30% to obtain a multicolor heat-sensitive recording material.

Here, the heat-sensitive recording layer coating solution (a) was coated so that the application amount of the diazo compound (A) contained therein became 0.078 g/m$^2$ in terms of a solid content coating amount and the heat-sensitive recording layer coating solution (b) was coated so that the application amount of the diazo compound (D) contained therein became 0.206 g/m$^2$ in terms of a solid content coating amount and the heat-sensitive recording layer coating solution (c) was coated so that the application amount of the electron-donating dye (H) contained therein became 0.355 g/m$^2$ in terms of a solid content coating amount.

In addition, the intermediate coating solution was applied so that the application amount thereof was 2.39 g/m$^2$ between heat-sensitive recording layers (a) and (b) and 3.34 g/m$^2$ between heat-sensitive recording layers (b) and (c) in terms of a solid content coating amount, and the application amount of the light transmittance adjusting layer coating solution was 2.35 g/m$^2$ in terms of a solid mater coating amount, and the application amount of the protective layer was 1.39 g/m$^2$ in terms of a solid content coating amount.

Examples 2 to 7 and Comparative Examples 1 to 3

Heat-sensitive recording materials were obtained in the same manner as in Example 1, except that the diazonium salt ad the oxonol dye in the magenta color-developing heat-sensitive recording layer were replaced with those shown in Table 1.

(2-1)

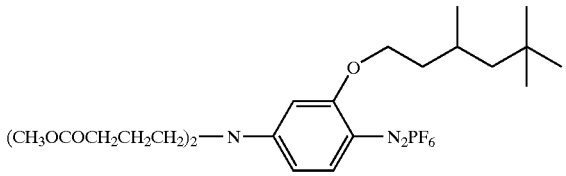

(2-2)

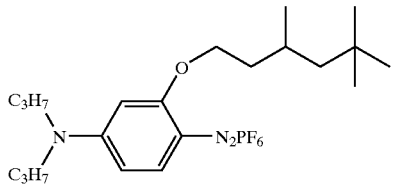

Evaluation Method

The prepared heat-sensitive recording materials were heated at 45° C. for 10 days, and a white image was printed thereon with a digital printer "NC370D" manufactured by Fuji Photo Film Co., Ltd., and color thereof was checked with naked eyes and measured with X-Rite 938 (light source: D65, angle of visiblity: 10°).

TABLE 1

| | Magenta heat-sensitive recording layer diazonium salt | Oxonol dye | Addition amount | L* | a* | b* | Whiteness with naked eyes |
|---|---|---|---|---|---|---|---|
| Example 1 | (2-1) | (1-1) | 0.13 Part | 91.1 | 0.9 | −6.7 | ○ |
| Example 2 | (2-1) | (1-2) | 0.13 Part | 91.1 | 0.8 | −7.0 | ○ |
| Example 3 | (2-1) | (1-1) | 0.20 Part | 91.1 | 1.4 | −6.9 | ○ |
| Example 4 | (2-1) | (1-2) | 0.20 Part | 91.0 | 1.2 | −7.2 | ○ |
| Example 5 | (2-2) | (1-1) | 0.13 Part | 91.1 | 0.9 | −6.7 | ○ |
| Example 6 | (2-2) | (1-2) | 0.13 Part | 91.6 | 0.9 | −7.0 | ○ |
| Example 7 | (2-1) | (1-3) | 0.13 Part | 91.0 | 0.7 | −6.7 | ○ |
| Comparative Example 1 | (2-1) | No addition | No addition | 91.3 | −0.4 | −5.9 | X |
| Comparative | (2-2) | No addition | No addition | 91.3 | −0.2 | −5.9 | X |

TABLE 1-continued

| | Magenta heat-sensitive recording layer diazonium salt | Oxonol dye | Addition amount | L* | a* | b* | Whiteness with naked eyes |
|---|---|---|---|---|---|---|---|
| Example 2 Comparative Example 3 | (2-1) | (2-4) | 0.13 Part | 91.0 | 0 | −7.0 | X |

Comparative Example Except for Oxonol (2-4)

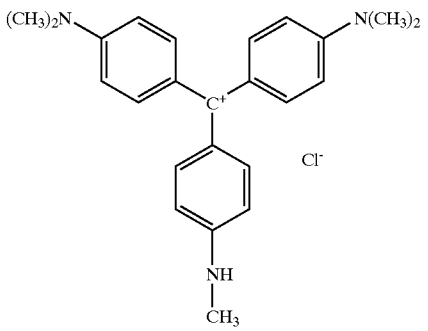

As seen from Table 1, in the heat-sensitive recording material of the invention, green stains were alleviated to a harmless level, and there was no problem with respect to whiteness with naked eyes.

What is claimed is:

1. A heat-sensitive recording material having a support and heat-sensitive recording layer, which contains a diazonium salt compound and a coupler compound that reacts with the diazonium salt to develop a color, wherein the recording material contains an oxonol dye represented by the following formula (1):

(1)

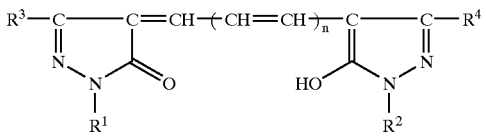

wherein in formula (1), $R^1$ and $R^2$ are a substituted aryl group having a substituent with a dissociable proton or a salt thereof, and $R^3$ and $R^4$ represent independently an alkyl group, an aryl group, a substituted aryl group or a COOR group (wherein R represents a hydrogen atom, an alkyl group or an aryl group); and n represents 0, 1 or 2, wherein the amount of the oxonol dye is $1\times10^{-6}$ to $1\times10^{-3}$ g/m$^2$.

2. A heat-sensitive recording material according to claim 1, wherein the diazonium salt compound is contained in microcapsules.

3. A heat-sensitive recording material according to claim 1, wherein the diazonium salt compound is represented by the following formula (2):

(2)

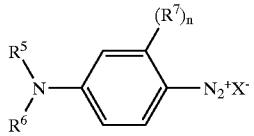

wherein in formula (2), $R^5$ and $R^6$ represents independently a hydrogen atom, a substituted or unsubstituted alkyl group, or a substituted or unsubstituted aryl group, provided that $R^5$ and $R^6$ may be the same or different as long as they are not both hydrogen atoms at the same time; $R^7$ represents a hydrogen atom, a substituted or unsubstituted alkyl group, a substituted or unsubstituted aryl group, a substituted or unsubstituted alkoxy group, a substituted or unsubstituted aryloxy group, a substituted or unsubstituted alkylthio group, a substituted or unsubstituted arylthio group, a halogen atom, or substituted amino group; $X^-$ represents an acid anion; and n represents an integer of 1 to 4.

4. A heat-sensitive recording material according to claim 1, wherein the amount of the oxonol dye is $5\times10^{-5}$ to $5\times10^{-4}$ g/m$^2$.

5. A heat-sensitive recording material according to claim 1, wherein the substituent with a dissociable proton, or a salt thereof, is COOH, $SO_3H$, or a salt thereof.

* * * * *